US007204572B2

(12) United States Patent
Seki et al.

(10) Patent No.: US 7,204,572 B2
(45) Date of Patent: Apr. 17, 2007

(54) INK-JET RECORDING APPARATUS AND CONTROL METHOD OF SAID APPARATUS

(75) Inventors: Satoshi Seki, Kanagawa (JP); Naoji Otsuka, Kanagawa (JP); Kiichiro Takahashi, Kanagawa (JP); Minoru Teshigawara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 10/953,946

(22) Filed: Sep. 29, 2004

(65) Prior Publication Data

US 2005/0073535 A1 Apr. 7, 2005

(30) Foreign Application Priority Data

Oct. 1, 2003 (JP) ..... 2003-343689

(51) Int. Cl.
*B41J 29/38* (2006.01)

(52) U.S. Cl. ..... 347/16; 347/5

(58) Field of Classification Search ..... 347/16
See application file for complete search history.

(56) References Cited

U.S. PATENT DOCUMENTS

| | | | | |
|---|---|---|---|---|
| 6,149,327 | A | 11/2000 | Ward | |
| 2002/0024574 | A1* | 2/2002 | Uchida | 347/16 |
| 2002/0196300 | A1* | 12/2002 | Takahashi et al. | 347/16 |
| 2004/0032465 | A1* | 2/2004 | Ottenheimer et al. | 347/65 |

* cited by examiner

*Primary Examiner*—Manish S. Shah
*Assistant Examiner*—Jannelle M. Lebrón

(57) ABSTRACT

An ink-jet recording apparatus applicable for two-side recording, which permits reliable reduction of smears caused by contact of the recording medium or secondary smears staining the following recording media by the ink adhering in the conveyance path, and obtaining high-quality images. After performing recording on the surface of the recording medium by the recording head for discharging ink, the recording medium is reversed for recording on the back thereof. For each of unit regions obtained by dividing the region corresponding to the surface of the recording medium, information about the quantity of ink to be applied to these unit regions is acquired, and the length of the operation downtime corresponding to the period of time from the end of the operation relating to recording on the surface of the recording medium up to the operation start relating to recording on the back of the recording medium is determined based on the acquired information.

15 Claims, 16 Drawing Sheets

RECORDING MEDIUM P1

FIG. 13

SMEAR TABLE 1

| | RECORDING OPERATION DOWNTIME T1 [sec] | | |
|---|---|---|---|
| | MODE 1 | MODE 2 | MODE 3 |
| Rmax≧50% | 30 | 30 | 5 |
| 50%>Rmax≧30% | 15 | 10 | 0 |
| 30%>Rmax | 5 | 0 | 0 |

FIG. 14

SMEAR TABLE 2

| | FIXING TIME T2 [sec] | | |
|---|---|---|---|
| | MODE 1 | MODE 2 | MODE 3 |
| Te≧25℃ | 30 | 20 | 10 |
| 25℃>Te≧15℃ | 15 | 10 | 0 |
| 15℃>Te | 5 | 0 | 0 |

FIG. 15

SMEAR TABLE 3

| | FIXING TIME T3 [sec] | | |
|---|---|---|---|
| | MODE 1 | MODE 2 | MODE 3 |
| (Thed-Te)≧20℃ | 15 | 10 | 10 |
| 20℃>(Thed-Te)≧10℃ | 10 | 5 | 0 |
| 10℃>(Thed-Te) | 5 | 0 | 0 |

FIG. 16

| | Bk (PIGMENT INK) | PCBk (DYE INK) |
|---|---|---|
| SURFACE | 37.2% | 24.7% |
| BACK | 43.5% | 12.2% |

FIG. 18

SMEAR TABLE 4

| | OPERATION DOWNTIME T4 [sec] | | |
|---|---|---|---|
| | RECORDING MODE 1 | RECORDING MODE 2 | RECORDING MODE 3 |
| Dmax≧TH2 | 30 | 30 | 5 |
| TH2>Dmax≧TH1 | 15 | 10 | 0 |
| TH1>Dmax | 5 | 0 | 0 |

FIG. 19

SMEAR TABLE

| NUMBER OF RECORDED DOTS X (NUMBER) | 0≦X<N1 | N1≦X<N2 | N2≦X |
|---|---|---|---|
| OPERATION DOWNTIME T (sec) (TA<TB<TC) | TA | TB | TC |

INK-JET RECORDING APPARATUS AND CONTROL METHOD OF SAID APPARATUS

This application claims priority from Japanese Patent Application No. 2003-343689 filed Oct. 1, 2003, which is hereby incorporated by reference herein.

BACKGROUND OF THE INVENTION

1. Field of the Invention

The present invention relates to an ink-jet recording apparatus which performs recording by discharging ink on a recording medium and a control method thereof. More particularly, the invention relates to an ink-jet recording apparatus which permits recording on two surfaces of the recording medium and a control method thereof.

2. Description of the Related Art

Recording apparatuses recording images comprising dot patterns on a recording medium such as paper and a plastic sheet on the basis of recording information are generally known as applicable to printers, copying machines and facsimile machines.

Types of recording for forming an image comprising dot patterns as described above include the ink-jet type, the wire dot type, the thermal type and the laser beam type. Among these, the ink-jet type discharges and ejects ink (recording solution) drops from a discharge port of a recording head, and causes adhesion thereof to a recording medium, thereby accomplishing recording. This type can therefore provide an advantage of allowing construction at a relatively low cost. In this ink-jet type, however, which uses ink composed of an aqueous solution, in order to ensure sufficient fixing of the recorded image, it is necessary to vaporize the water content of the ink discharged onto the recording medium, thus requiring some time (fixing time).

In an apparatus of a low recording speed, since there is a time available before recording of the next page, fixing of ink has posed almost no problem. However, in a high-speed recording type ink-jet recording apparatus outputting five or more A4-size sheets per minute, particularly, in a recording apparatus outputting ten or more sheets per minute, there is a risk of an occurrence of smears during paper discharge. More specifically, in an ink-jet recording apparatus permitting high-speed recording, if there exists a region of a high recording ratio, the next recorded recording medium is discharged while ink drying is still incomplete and overlaps the latter. The insufficiently dried ink adheres to the back of the next recording medium, thus causing a feat of image deterioration on the previously discharged recording medium discharged in advance, and of an occurrence of smears in which the back of the recording media discharged next is stained.

In the ink-jet recording apparatus, a smear may also be produced when automatically performing recording on two surfaces of the recording medium. That is, in an ink-jet recording apparatus having a double-sided recording function, after performing recording on one of the surfaces of the recording medium (hereinafter referred to as the "surface" or the "first recorded surface"), the recording medium is fed again into a conveyance path for reversing. The recording medium is reversed here, and the recording operation is applied to the other surface thereof (hereinafter referred to as the "back" or the "second recorded surface"). This leads to re-introduction of the insufficiently dried recording medium into the conveyance path for reversing. The recording medium is rubbed against the conveyance path for reversing, resulting in occurrence of smears including the degrading of the recorded image, and furthermore, the thus produced smears cause another inconvenience of an occurrence of secondary smears in which the above-mentioned smears cause the ink adhering in the conveyance path to be transferred to the next recording medium.

It is therefore desirable to provide a drying period between the end of recording on one of the surfaces of the recording medium and the start of recording on the other surface (back) of the recording medium, and reverse the recording medium after ensuring sufficient drying of ink to prevent an ink stain from occurring. Under the current circumstances including an increasing demand for a higher speed and a higher quality, the drying period should preferably be the shortest possible. An apparatus for inhibiting ink stains by setting a drying period in response to the number of ink application runs to the entire area of one of the surfaces of the recording medium, without providing an excessive drying period has been proposed (for example, see the U.S. Pat. No. 6,149,327 specification).

However, in the technology disclosed in the above-mentioned U.S. Pat. No. 6,149,327 specification, in which drying time is set in response to the number of recorded dots over the entire area of one surface of the recording medium, even with a small area having a high printing duty (for example, a small solid printing area), the number of recorded dots is determined to be small as a whole, resulting in setting of a short drying period. In a state in which drying of a solid printing area has not as yet been accomplished, the recording medium is input again into the conveyance path. This leads to a possibility of an occurrence of stains caused by the ink.

When performing two-side recording with dye-based ink, dye-based ink tends to easily penetrate into the recording medium. The ink discharged onto one surface penetrates too far into the recording medium, i.e., a phenomenon known as ink fallout may occur. In this case, the content recorded on the one surface is transferred to the other side, and similarly, the content of recording discharged onto the other side is transferred to the first side, thus causing a problem in that it becomes difficult to discriminate the recorded content.

SUMMARY OF THE INVENTION

The present invention was developed to solve the above-mentioned problems and has an object to provide an ink-jet recording apparatus which enables, in an ink-jet recording apparatus permitting two-side recording, to inhibit smears occurring by contact of the recording medium with the conveyance path, or secondary smears which stain the next and subsequent recording media by the ink adhering to the conveyance path, and to reduce the drying time provided for such inhibition as far as possible, and a control method of this apparatus.

To solve the problems in the above-mentioned conventional technologies, the present invention has the following configuration.

More specifically, to solve the above-mentioned problems, the present invention provides an ink-jet recording apparatus which permits recording on one surface of a recording medium and the other surface thereof by causing a recording head for discharging ink to relatively scan the recording medium, comprising acquiring means of acquiring information about the quantity of ink to be applied to a unit region for each such unit region obtained by dividing a region corresponding to the one surface of the recording medium into a plurality of portions; and determining means which determines the length of time from the end of operation relating to recording on one of the surfaces of the recording medium, until the start of operation relating to recording on the other surface of the recording medium; wherein the determining means determines the length of time on the basis of information about the quantity of applied ink for each unit region acquired by the acquiring means.

The present invention also provides an ink-jet recording apparatus which permits recording on one and the other surfaces of a recording medium by causing a recording head for discharging ink to perform relative scanning of the recording medium, comprising judging means which judges a specified recording mode from among a single-sided recording mode comprising the steps of performing recording on one of the surfaces of the recording medium, and then, discharging the recording medium on one of the surfaces of which recording has been conducted, and a two-side recording mode comprising the steps of performing recording on one of the surfaces of the recording medium, then, reversing the recording medium after the recording in the apparatus, and performing recording on the other surface of the recording medium; acquiring means which acquires information about the quantity of ink to be applied to a unit region for each of the unit regions obtained by dividing the area corresponding to one surface of the recording medium, when the double-sided recording mode is specified; and determining means which determines the length of time from the end of operation relating to recording on one of the surfaces of the recording medium, until the start of operation relating to recording on the other surface of the recording medium; wherein the determining means determines the length of time on the basis of information about the quantity of applied ink for each unit region acquired by the acquiring means.

The present invention also provides an ink-jet recording apparatus in which, after performing recording on one of the surfaces of a recording medium conveyed along a first conveyance path by discharging ink from a recording head, the recording medium is conveyed along a second conveyance path at least partially different from the first conveyance path, and then, recording is performed by means of the recording head on the other surface of the recording medium, comprising acquiring means which acquires information about the quantity of ink to be applied to each unit region of a plurality of unit regions obtained by dividing the region corresponding to one of the surfaces of the recording medium into a plurality of portions; determining means which determines an operation downtime on the basis of the information about the quantity of applied ink acquired as above; and operation stopping means which performs control so that the recording medium after recording on the one surface does not start conveyance operation along the second conveyance path for a period after the end of the operation relating to recording on the one surface of the recording medium until the lapse of the determined operation downtime.

The present invention also provides a method for controlling an ink-jet recording apparatus which causes a recording head for discharging ink to relatively scan a recording medium, thereby permitting recording on one surface and the other of the recording medium, comprising an acquiring step of acquiring information about the quantity of ink to be applied to individual unit regions obtained by dividing the region corresponding to the one surface of the recording medium, for each such unit region; a determining step for determining the length of time from the end of operation relating to recording on one of the surfaces of the recording medium until the start of operation relating to recording on the other surface of the recording medium; wherein, in the determining step, the length of time is determined on the basis of the information about the quantity of applied ink for the individual unit regions acquired in the acquiring step.

According to the above-mentioned configuration, (1) information about the quantity of applied ink for each of unit regions obtained by dividing the region corresponding to one of the surfaces of the recording medium into a plurality of portions (for example, the recording duty, the quantity of applied ink, the number of recorded dots, etc.) is acquired, and (2) the period of time from the end of operation relating to recording on one of the surfaces of the recording medium until the start of operation relating to recording on the other surface (hereinafter referred to as the operation downtime or the drying time) is determined on the basis of the information about the quantity of applied ink for each unit region. It is therefore possible to inhibit occurrence of ink stains even while reducing the drying time. The end of operation relating to recording on one of the surfaces of the recording medium as herein used means a point in time when the last scanning run is completed and the recording operation is discontinued, i.e., the time point when the recording operation is in stopped state. On the other hand, the start of operation relating to recording on the other surface means the moment when the above-mentioned recording operation stopping state is cancelled, and the operation is resumed (for example, the conveying operation necessary for the recording on the other surface, or the conveying operation for reversing the recording medium).

During the period from the end of operation relating to recording on one of the surfaces of the recording medium until the start of operation relating to recording on the other surface, the operation is in a stopped state. This period may hereafter sometimes be referred to as an operation downtime. From the point of view of function, the above-mentioned period is provided for drying (or fixing) the ink recorded on the surface. Therefore, the above-mentioned period may sometimes be referred to as a drying time (or the fixing time).

Further objects, features and advantages of the present invention will become apparent from the following description of the preferred embodiments (with reference to the attached drawings).

BRIEF DESCRIPTION OF THE DRAWINGS

FIG. 6A relates to a case where the recorded region R and the dot count region W are in agreement; and FIG. 6B relates to a case where the recorded region R and the dot count region W are not in agreement;

FIG. 13 illustrates a typical smear table applied to the third embodiment of the present invention;

FIG. 14 illustrates a typical smear table applied to the fourth embodiment of the present invention;

FIG. 15 illustrates a typical smear table applied to the fourth embodiment of the present invention;

FIG. 16 illustrates the ink discharge ratio of Bk ink to PCBk ink applied upon application of the double-sided recording operation in the fifth embodiment of the present invention;

FIG. 18 illustrates a typical smear table applied to a variation of the second embodiment of the present invention; and FIG. 19 illustrates a typical table applied to the first embodiment of the present invention.

DESCRIPTION OF THE PREFERRED EMBODIMENTS

Embodiments of the present invention will now be described in detail with reference to the drawings.

Figure 1:
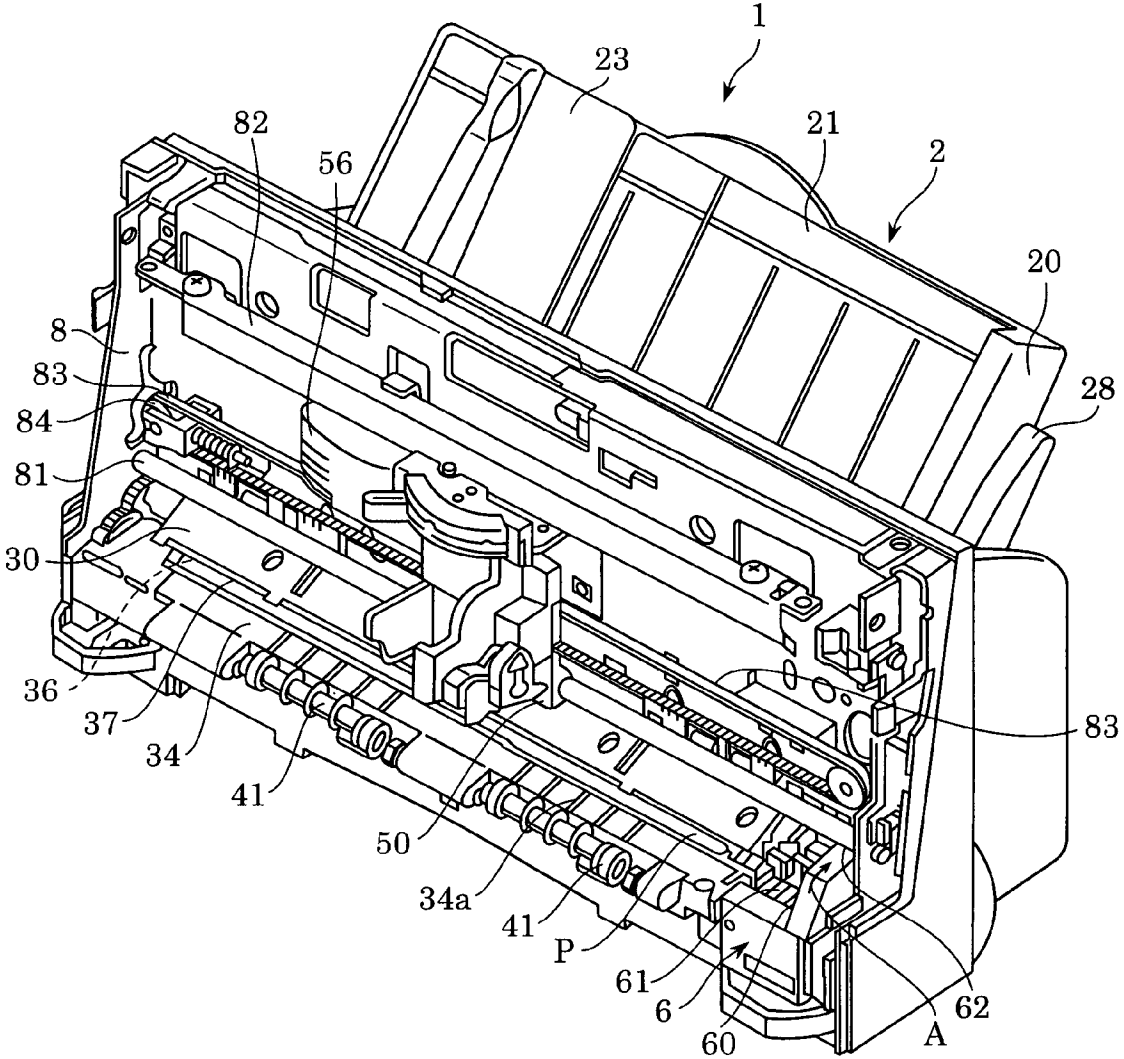
FIG. 1 is a perspective view illustrating the whole configuration view of the ink-jet recording apparatus in an embodiment of the present invention.
Figure 2:
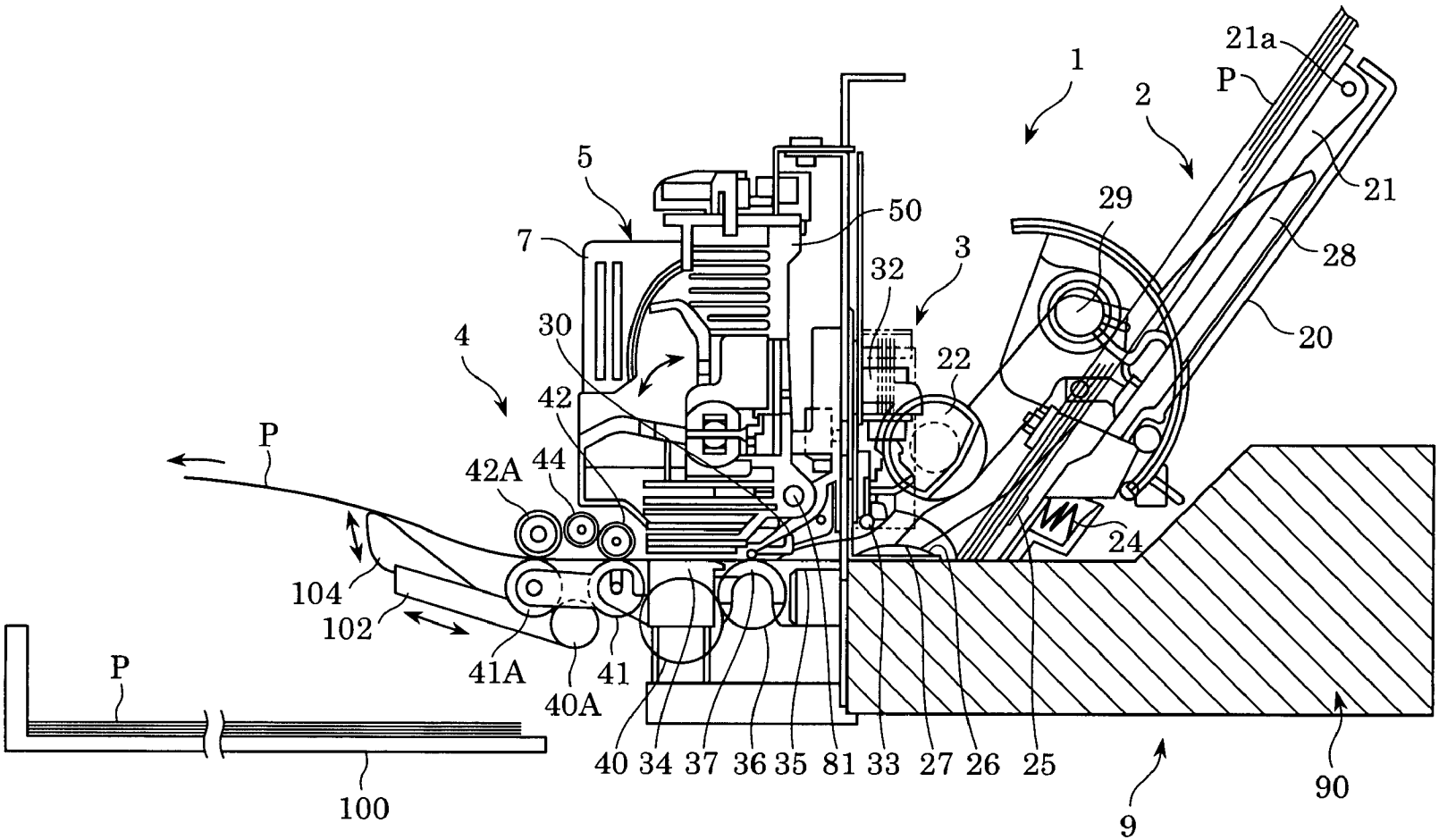
FIG. 2 is a side sectional view of the ink-jet recording apparatus in the embodiment of the present invention.
Figure 3:
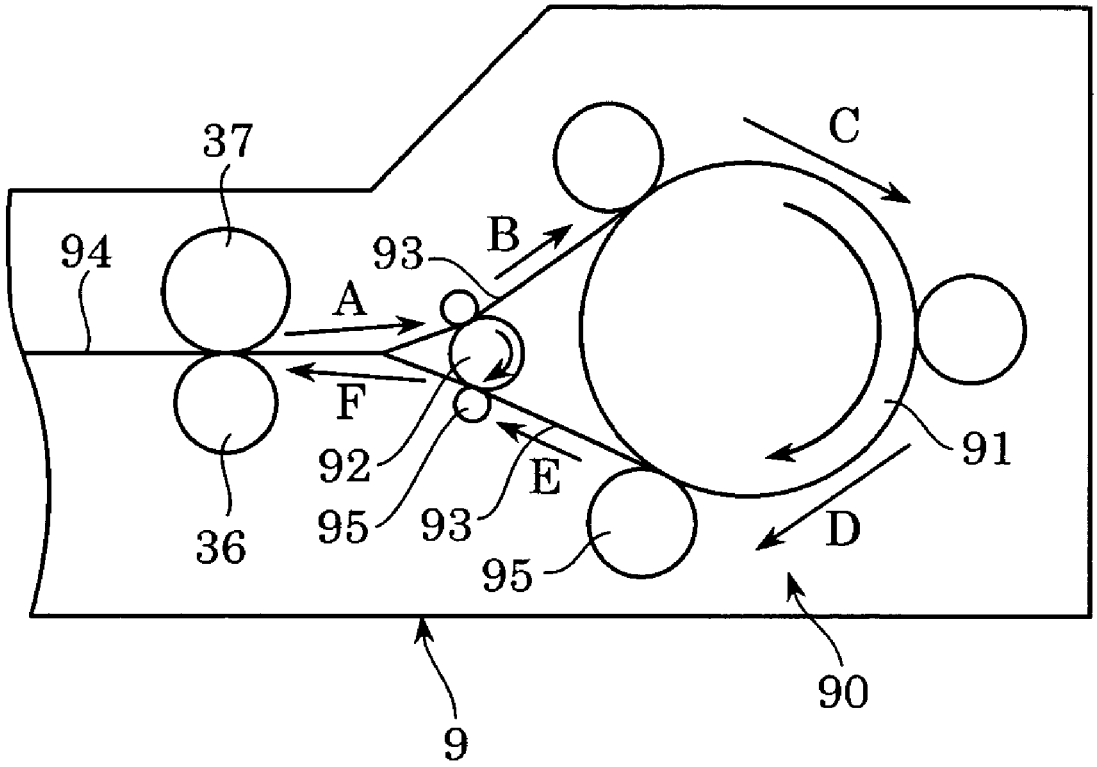
FIG. 3 is a descriptive side view illustrating a schematic configuration of a recording medium reversing section in the embodiment of the present invention.

The whole configuration of the ink-jet recording apparatus will be described in detail with reference to FIGS. 1 to 3. This ink-jet recording apparatus mainly comprises a paper feed section 2, a paper conveying section 3, a paper discharge section 4, a carriage section 5, and a cleaning section 6. A schematic configuration of these sections will be described sequentially in the order of the following sections (I) to (VI). FIG. 1 is a perspective view illustrating the whole configuration view of the ink-jet recording apparatus in an embodiment of the present invention; FIG. 2 is a side sectional view of the ink-jet recording apparatus 1; and FIG. 3 is a schematic view of a recording medium reversing section 9 including a reversing unit 90. (I) The paper feed section, (II) the paper conveying section, (III) the carriage section, (IV) the cleaning section, (V) the paper feed section, and (VI) the recording medium reversing section will now be described with reference to FIGS. 1 to 3.

(I) Paper Feed Section

The paper feed section 2 has a configuration in which a pressure plate 21 loading a reversing medium and a feed rotor 22 feeding a recording medium P are attached to a base 20. A movable side guide 23 is movably attached to the pressure plate 21. This movable side guide 23 regulates the mounting position of the recording medium P. The pressure plate 21 is rotatable around a rotation shaft 21*a* connected to the base 20, and is energized by a pressure plate spring 24 toward a feed rotor 22. To prevent duplication of feeding of the recording medium P, a separation pad 25 comprising a material having a high frictional coefficient such as an artificial leather is provided on the portion of the pressure plate 21 opposite to the feed rotor 22. In addition, a separation claw 26 for separating the recording media P sheet by sheet, covering a corner in a direction of the recording medium P; a weir 27 formed integrally with the base 20 for separating cardboard or the like to which the separation claw is not applicable; a switch lever 28 which ensures acting of the separation claw 26 at the plain paper position and prevents action of the separation claw at the cardboard position; and a release cam 29 which releases the contact between the pressure plate 21 and the feed rotor 22 are provided on the base 20.

In the above-mentioned configuration, the release cam 29 pushes the pressure plate 21 down to a prescribed position during standby state. As a result, the contact of the recording medium P and the feed rotor 22 mounted on the pressure plate 21 is in a released state. When, in this state, the driving force of the conveyance roller 36 is transmitted by gears or the like to the feed rotor 22 and the release cam 29, which leaves the pressure plate 21, the pressure plate 21 moves up; the feed rotor 22 and the recording medium P come into contact with each other; the recording medium P is picked up along with the rotation of the feed rotor 22 and begins being fed; and the recording medium P is separated sheet by sheet by the separation claw 26 and fed to the paper feed section. The feed rotor 22 and the release cam 29 rotate until the recording medium P is fed to the paper feed section 3, and at the point in time when feeding to the paper feed section 3 is completed, the contact of the recording medium P with the feed rotor 22 is released again into the standby state, and the driving force from the conveyance roller 36 is shut off.

(II) Paper Feed Section

The paper feed section 3 has a conveyance roller 36 which conveys the recording medium P and a PE sensor 32. A pinch roller 37 which rotates following the rotation of the conveyance roller 36 is provided on the conveyance roller 36.

The pinch roller 37 is rotatably supported by a pinch roller guide 30, and by energizing the pinch roller guide 30 with a pinch roller spring 31, the pinch roller 37 is caused to come into pressure-contact with the conveyance roller 36, thereby producing a conveyance force of the recording medium P. In addition, an upper guide 33 which guides the recording medium P and a platen 34 are arranged at the entry of the paper feed section 3. A PE sensor lever 35 which transmits detection of the leading end and the trailing end of the recording medium P to the paper end sensor (PE sensor) 32 is provided on the upper guide 33.

In the above-mentioned configuration, the recording medium P, sent to the paper feed section 3 and guided by the platen 34, the pinch roller guide 30 and the upper guide 33, is further sent to the roller pair of the conveyance roller 36 and the pinch roller 37. At this point in time, the PE sensor lever 35 rotates by being pushed by the leading end of the recording medium P, and the PE sensor 32 detects this rotation. The controller described later determines the recording position of the recording medium P on the basis of a detection signal of this PE sensor 32. The recording medium P is conveyed on the platen 34 by rotation of the roller pair 36 and 37 under the effect of a conveyance motor (not shown).

The recording head 7 is replaceably attached to a carriage 50 described later, and has a configuration in which it releasably holds an ink tank. A plurality of nozzles are arranged on this recording head 7, and thermo-electric conversion elements such as heaters are arranged in the individual nozzles. By dividing these thermo-electric conversion elements, heat is imparted to the ink, and causes the ink to produce membrane boiling. A change in pressure caused by growth or contraction of bubbles at this moment causes discharge of the ink from the nozzles to form an image on the recording medium P.

(III) Carriage Section

The carriage section 5 has a carriage 50 to which the recording head 7 is replaceably mounted. The carriage 50 is supported movably in the main scanning direction by a guide shaft 81 extending in the main scanning direction perpendicular to the conveying direction of the recording medium P (sub-scanning direction) and a guide rail 82 which maintains the gap between the recording head 7 and the recording medium P. This guide shaft 81 and the guide rail 82 are attached to a chassis 8. The carriage 50 is driven via a timing belt 83 by a carriage motor (not shown) attached to the chassis. The timing belt 83 is supported by an appropriate tension between idle pulleys 84. A flexible substrate 56 for transmitting a head driving signal from an electric substrate 9 to the recording head 7 is connected to the carriage 50.

In the above-mentioned configuration, when an image is formed on the recording medium P, the recording medium P is conveyed by the rotation of the roller pair 36 and 37 in the sub-scanning direction, and the recording medium P is caused to move to the recording position on the platen 34. The carriage 50 is driven by the carriage motor 80, and the recording head 7 is moved to the image forming position on the recording medium P in the main scanning direction. Subsequently, the carriage 50 moves toward the main scanning direction in accordance with a recording start instruction, and the image is formed by discharging the ink from the recording heat 7 toward the recording medium P in response to a signal from the electric substrate 9.

Attachment and detachment of the recording head 7 to and from the carriage 50, and attachment and detachment of the ink tank to and from the recording head 7 are accomplished by causing the carriage 50 to a prescribed replacement position by pressing an operating key (not shown) and replacing the component at this replacement position.

(IV) Cleaning Section

The cleaning section 6 comprises a pump 60 which performs cleaning of the recording head 7, a cap 61 for inhibiting drying of the recording head 7, and a drive switching arm 62 which switches over the rotating driving force of the conveyance roller 36 to the paper feed section 2 and the pump 60. In a case other than paper feed or cleaning, the driving force is not transmitted to the paper feed section 2 or the pump 60 because the drive switching arm 62 fixes a planetary gear (not shown) rotating around the axial center of the conveyance roller 36 at a prescribed position. When the drive switching arm 62 is moved in the arrow A direction under the effect of movement of the carriage 50, the planetary gear becomes free. The planetary gear (not shown) therefore moves in response to positive or negative rotation of the conveyance roller 36: the positive rotation of the conveyance roller 36 causes the driving force to be transmitted to the paper feed section 2, and the negative rotation causes the driving force to be transmitted to the pump 60.

(V) Paper Discharge Section

Two paper discharge rollers 41 and 41A are arranged at positions of different sub-scanning directions in the paper discharge section 4 which comprises a transmission roller 40 in contact with the conveyance roller 36 and the paper discharge roller 41, and the transmission roller 40 in contact with the paper discharge roller 41 and the paper discharge roller 41A. Therefore, the rotating driving force of the conveyance roller 36 is transmitted to the paper discharge roller 41 via the transmission roller 40, and this rotating driving force is further transmitted to the paper discharge roller 41A via the transmission roller 40A.

Spurs 42 and 42A are in contact with the paper discharge rollers 41 and 41A, respectively, so as to be rotatable following the rotation of the paper discharge rollers 41 and 41A, and a cleaning roller 44 is rotatably in contact with the spurs 41 and 41A. In the above-mentioned configuration, the recording medium P on which the image has been formed in the carriage section 5 is held between the above-mentioned paper discharge roller 41 and 41A and the spurs 42 and 42A, is conveyed by the rotation of these rollers, and is discharged onto a paper discharge tray 100.

A paper discharge support 104, described later, for supporting the recording medium P discharged after recording is provided in the downstream of the paper discharge roller 41A. The paper discharge support 104 is attached rotatably to a guide member 102. The guide member 102 is supported linearly movably between a projecting position from the platen 34 and a retracted position onto the platen 34. The paper discharge support 104 performs rotating operation along with the movement of this guide member 102. The conveyance path of the recording medium from the above-mentioned paper feed section 2 through the recording head 7 to the paper discharge support 104 forms a first conveyance path.

(VI) Recording Medium Reversing Section

The recording medium reversing section 9 comprises a paper feed conveyance path 94 following the above-mentioned first conveyance path, the conveyance roller 36 and a reversing unit 90 positioned on the back (to the right in FIG. 2) of the ink-jet recording apparatus 1. The reversing unit 90 is composed of a paper holding roller 95, a reversing small roller 92, a loop-shaped reversing conveyance path 93, and a reversing large roller 91. The conveyance roller 36 can be rotation-driven by a motor in the positive and the negative directions. The above-mentioned paper feeding conveyance path 94 and the above-mentioned reversing conveyance path 93 form a second conveyance path. The reversing unit 90 is attachable to the recording apparatus.

When conducting automatic two-side recording, recording is performed on one of the surfaces of the recording medium P fed from the paper feed section 2 (referred to as the "surface" or the "first recording surface") by conveying the recording medium P in the positive direction. Then, the conveyance roller 36 is driven in a reverse direction to send the recording medium P in the paper feed conveyance path 94 to the reversing conveyance path 93, where the surface/back of the recording medium P is reversed. More specifically, the recording medium P passes through the reversing conveyance path 93 in a sequence of A→B→C→D→E→F→G, as shown in FIG. 3, thus reversing the surface/back surface. Subsequently, the recording medium P of which the surface and the back have been reversed is sent through the paper feed conveyance path 94 again to the platen 34 so that the other surface (referred to as the "back" or the "second recording surface") is subjected to recording only the recording head 7.

Figure 4:
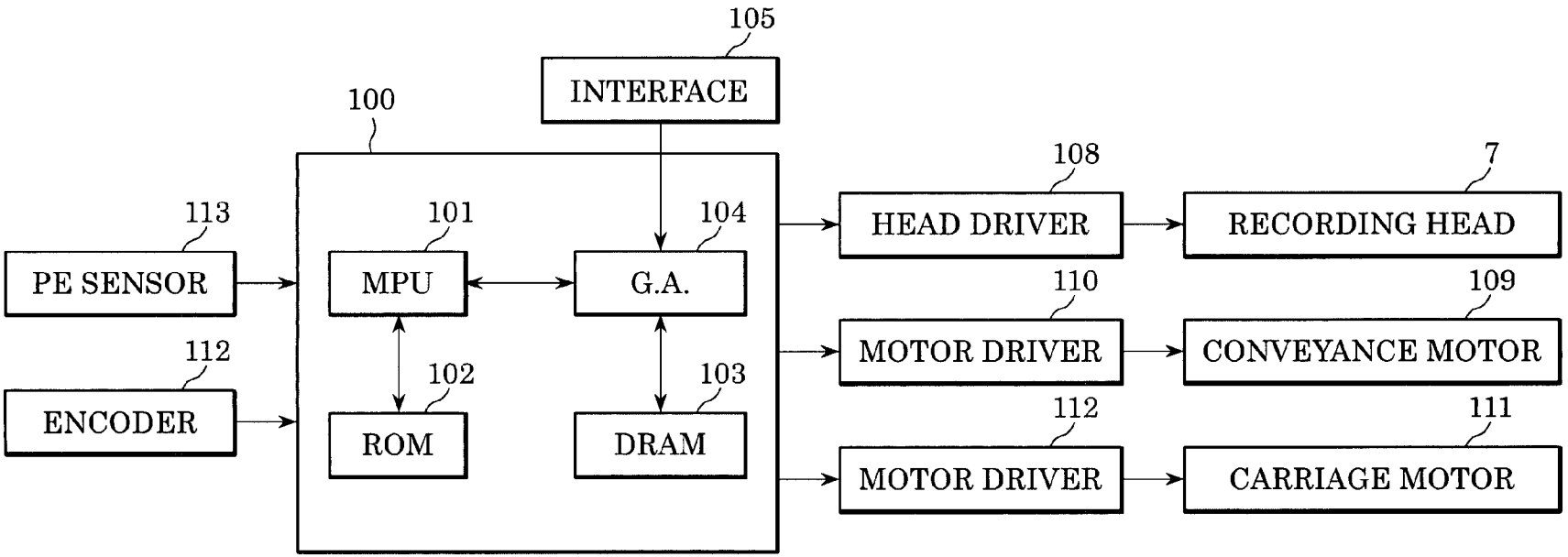
FIG. 4 is a block diagram schematically illustrating the configuration of the control system of the ink-jet recording apparatus in the embodiment of the present invention.

An outline of the configuration of the control system of this ink-jet recording apparatus will now be described with reference to FIG. 4. In FIG. 4, reference numeral 100 represents a control section which performs control of individual driving sections of the ink-jet recording apparatus of this embodiment, and has an MPU 101 performing processes such as various operations, determination and control; a ROM 102 storing programs and the like for execution by this MPU 101; a DRAM 103 which temporarily stores the entered data and functions as a work area for arithmetic operations by the MPU 101; and a gate array (G.A.) 104. An interface 105 for exchanging signals with external devices such as a host computer (not shown) is connected to the control section 100. Signals entered therefrom are entered into the MPU 101 and the DRAM 103 via the above-mentioned gate array 104. A head driver 108 which drives heaters provided in the individual nozzles of the recording head 7, a motor driver 110 which drives a conveyance motor 109 rotationally driving the conveyance roller 36 and the like, and a motor driver 112 which drives a carriage motor 111 driving the carriage 50 are connected to this controller 100.

An encoder 112 which detects the position of the carriage 50 and the above-mentioned PE sensor 113 are connected to the controller 100.

In the control system having the configuration described above, when data to be recorded is sent from the host computer via the interface 105, the data is temporarily stored via the gate array 104 into the DRAM 103. Thereafter, the data in the DRAM 103 is converted by the gate array 104 from raster data into recording image data for recording with the recording head 7, and is stored again in the DRAM 103. The data is sent again by the gate array 104 via the head driver 108 to the recording head 7. The heater at the corresponding nozzle position is driven to generate heat, and the ink is discharged by the resulting heat energy for recording. The counter of dots to be recorded is held on the gate array 104 to permit counting of the number of recorded dots at a high rate.

The carriage motor 111 is activated via the motor driver 112 of the carriage motor 111, and the recording head 7 is moved in the main scanning direction, together with the carriage 50, in match with the dot forming rate of the recording head 7. In this case, interruption control is applied to the gate array 104 from the MPU 100 every 10 msec, and the amount of integration of counter values of the number of counted dots is read out. This permits acquisition of information about the number of dots to be recorded in unit region during a unit period of time. It is also possible to calculate a recording duty per unit region on the basis of this number of recorded dots per unit region. The number of recorded dots per unit region as herein used means a number of actually recorded dots for each of a plurality of unit regions (dot count regions W) obtained by dividing the regions on the recording medium into a plurality of portions. The recording duty per unit region is a result of calculation of the following formula: Formula (1): Recording duty=(number of actually recorded dots within a unit region)/(number of recordable dots within a unit region)×100.

Figure 5:
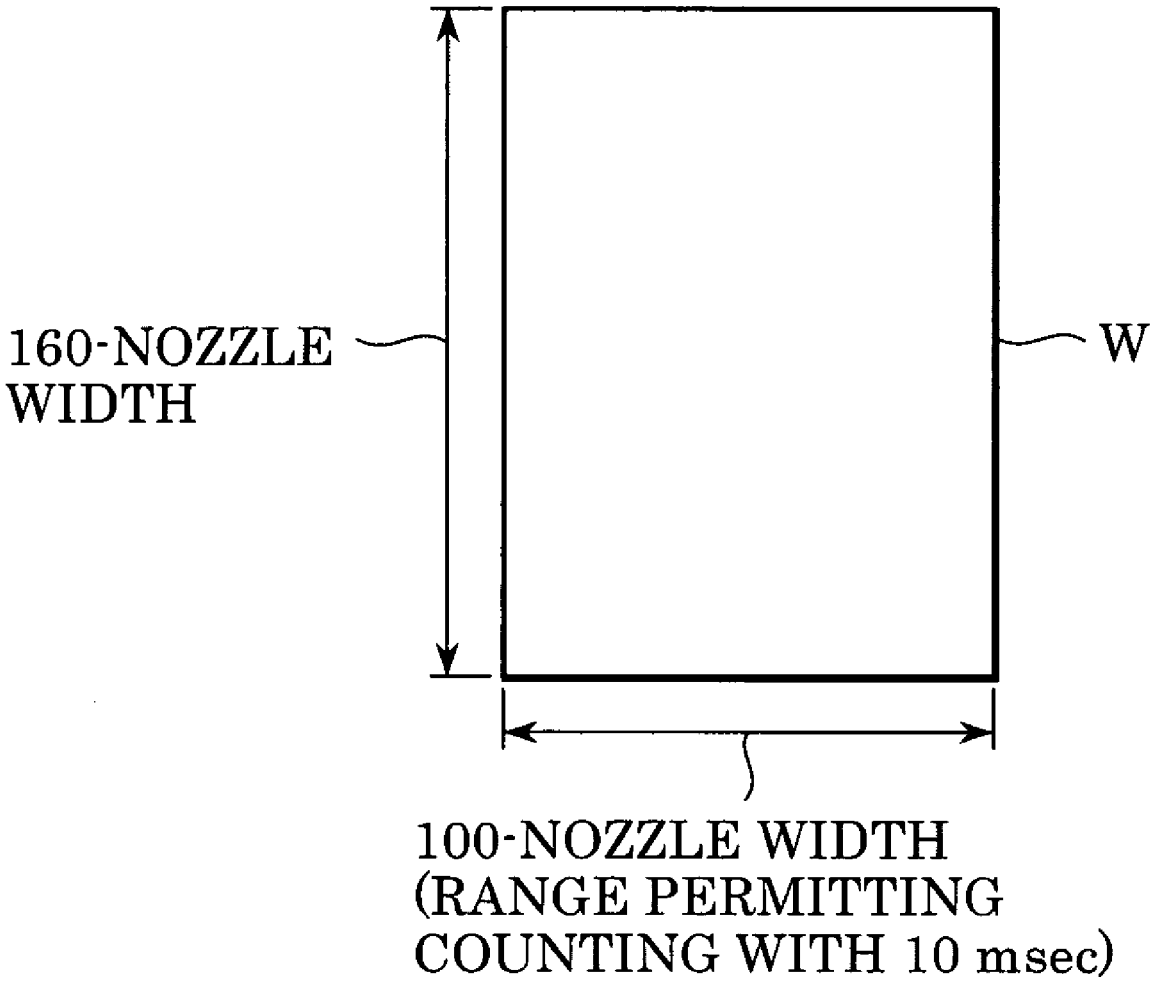
FIG. 5 illustrates a dot count region corresponding to the unit region to be subjected to dot counting.

More specifically as to the recording duty, as shown in FIG. 5, in a recording head having a nozzle train width of 160 nozzles, the number of recorded dots during 10 msec (corresponding to 100-dot width in the main scanning direction when driving the recording head at 10 kHz) is counted. The recording duty for a unit region can be calculated on the basis of the resultant count value and the time (10 msec). In this case, the total number of dots within the dot count region W (detection region) corresponding to the unit region is 160×100=16,000 dots. When 16,000 dots are recorded within this detection region, a recording duty of 100% is defined, and the recording duty is thus calculated for each unit region.

In the present invention, each of the plurality of divided regions resulting from division of the regions on the recording medium into a plurality of portions is defined as a dot count region W. The size of the dot count region W should preferably be relatively small. The reason thereof will be described with reference to FIGS. 6A and 6B.

Figure 6A:
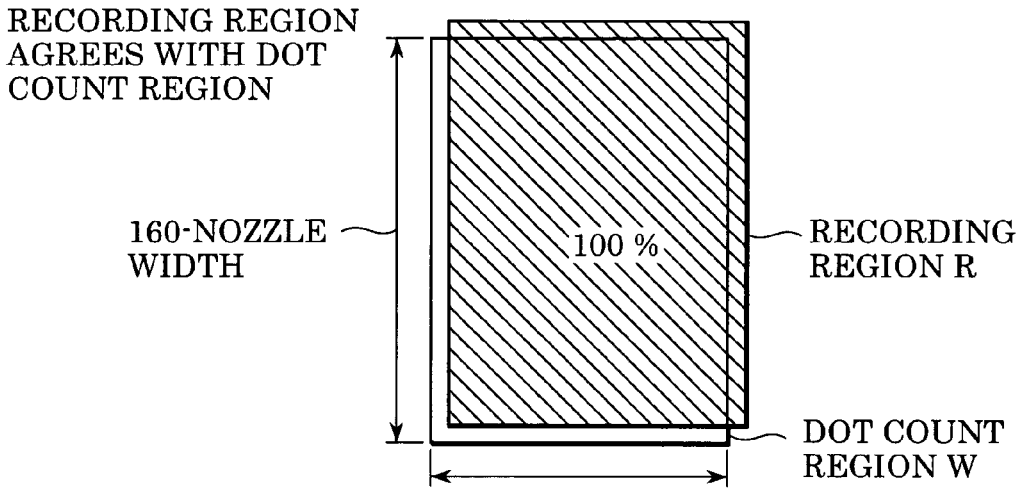
FIGS. 6A and 6B cover descriptive view illustrating the positional relationship between the dot count region W and an actual recorded region R.
Figure 6B:
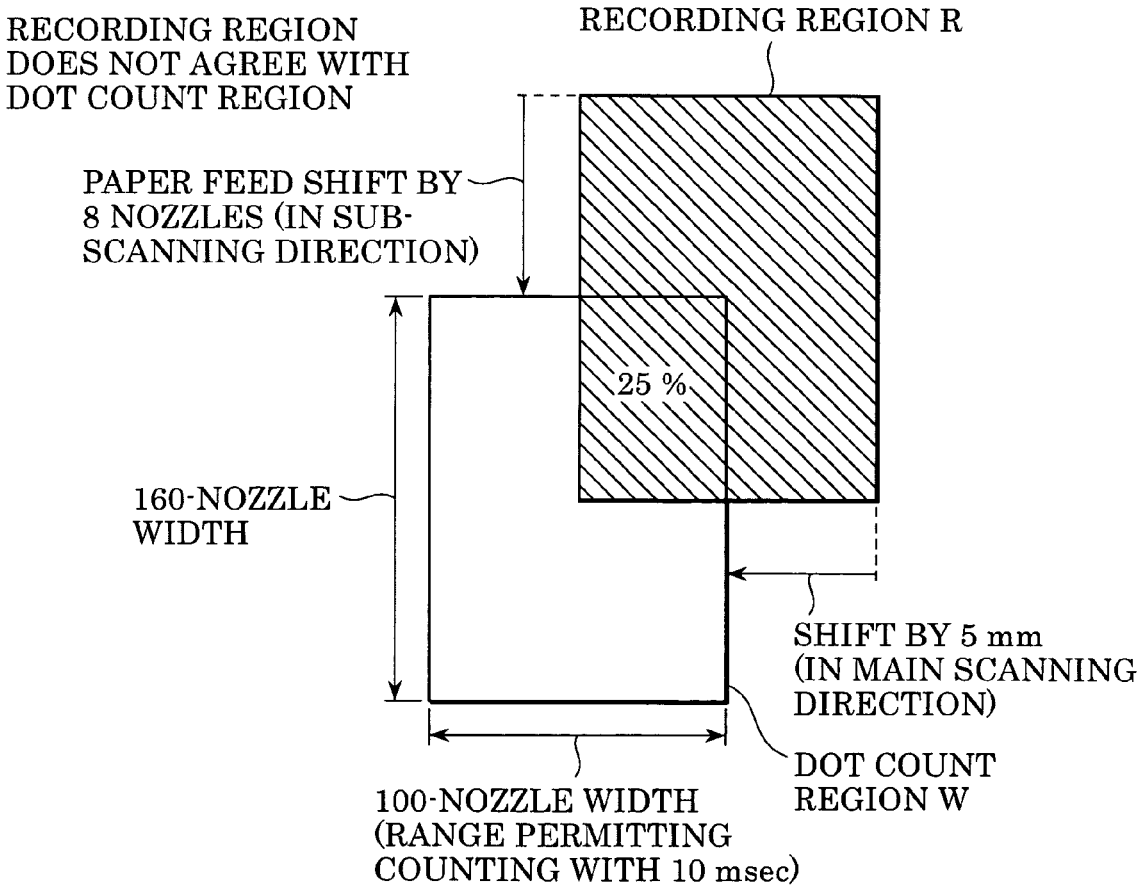

When there is a positional relationship as shown in FIGS. 6A and 6B between the recording region R (means a region in which recording is actually conducted) and the dot count region W on the recording medium, different results of detection may be obtained even for the same region, and this may form a detection error.

FIG. 6A illustrates a state in which a solid printing region R recorded at a recording duty of 100% completely overlaps a dot count region W (for convenience of showing these regions R and W, the recording region R and the dot count region W are shown at positions slightly apart from each other). In this case, all the dots recorded in the recording region are counted, leading to a detection result of a recording duty of 100%. In FIG. 6B, in contrast, the recording position deviates by 80 nozzles in the sub-scanning direction (up/down direction in FIG. 6B), relative to the position where recording should originally be made. FIG. 6B illustrates a case where further the read timing of data to be recorded shifts in the main scanning direction by 5 msec.

In this case, even if the recording region R shown in FIG. 6B presents quite the same recording duty as in the recording region R shown in FIG. 6A, only ¼ of the dots recorded in the recording region R agree with the dot count region W. Therefore, the detection result detected by the count region W in FIG. 6B is equal to a recording duty of 25%, thus producing a detection error. Such a detection error is difficult to find if the size of the recording region R is wider in the longitudinal as well as transverse directions than the dot count region W, leading to an improved detection accuracy. It is therefore very effective to reduce the size of the dot count region W by accomplishing counting by dividing the region in the nozzle train direction, or by reducing the interruption interval. If the dot count region W is smaller in size, the read error occurs for a very small solid region having a fair fixability. The possibility of causing problems is low in preventing occurrence of smears.

However, setting of an excessively smaller dot count region W may lead to an inconvenience of detecting a region having a low recording duty such as a text as having a high recording duty. The size of the dot count region W should therefore preferably be determined comprehensively and appropriately taking into account the above-mentioned circumstances. In order to avoid the above-mentioned inconvenience caused by an excessively reduced size of the dot count region W, the technique of accumulating results of detection of a plurality of neighboring dot count regions W and determining the extent of recording duty of these plurality of regions on the basis of the extent of this cumulative value is suitably applicable.

In the present invention, pieces of information about the quantity of ink to be imparted to the unit region include, for example, the number of dots recorded in a unit region, and the recording duty in a unit region. Information indirectly relating to the quantity of imparted ink can be suitably used in the present invention as described above. It is needless to mention that not only such indirect information, but also information expressed by converting this indirect information into a quantity of imparted ink, i.e., information directly showing the quantity of imparted ink may be applied. In the present invention, as described above, information about the number of recorded dots, information about recording duty, or information directly showing the quantity of imparted ink is applicable as information relating to the quantity of ink to be imparted to a unit region (for example, a dot count region W described later). In summary, all pieces of information relating directly or indirectly to the quantity of imparted ink per unit region are included in the above-mentioned information relating to the quantity of ink to be imparted to the unit region.

Figure 8:
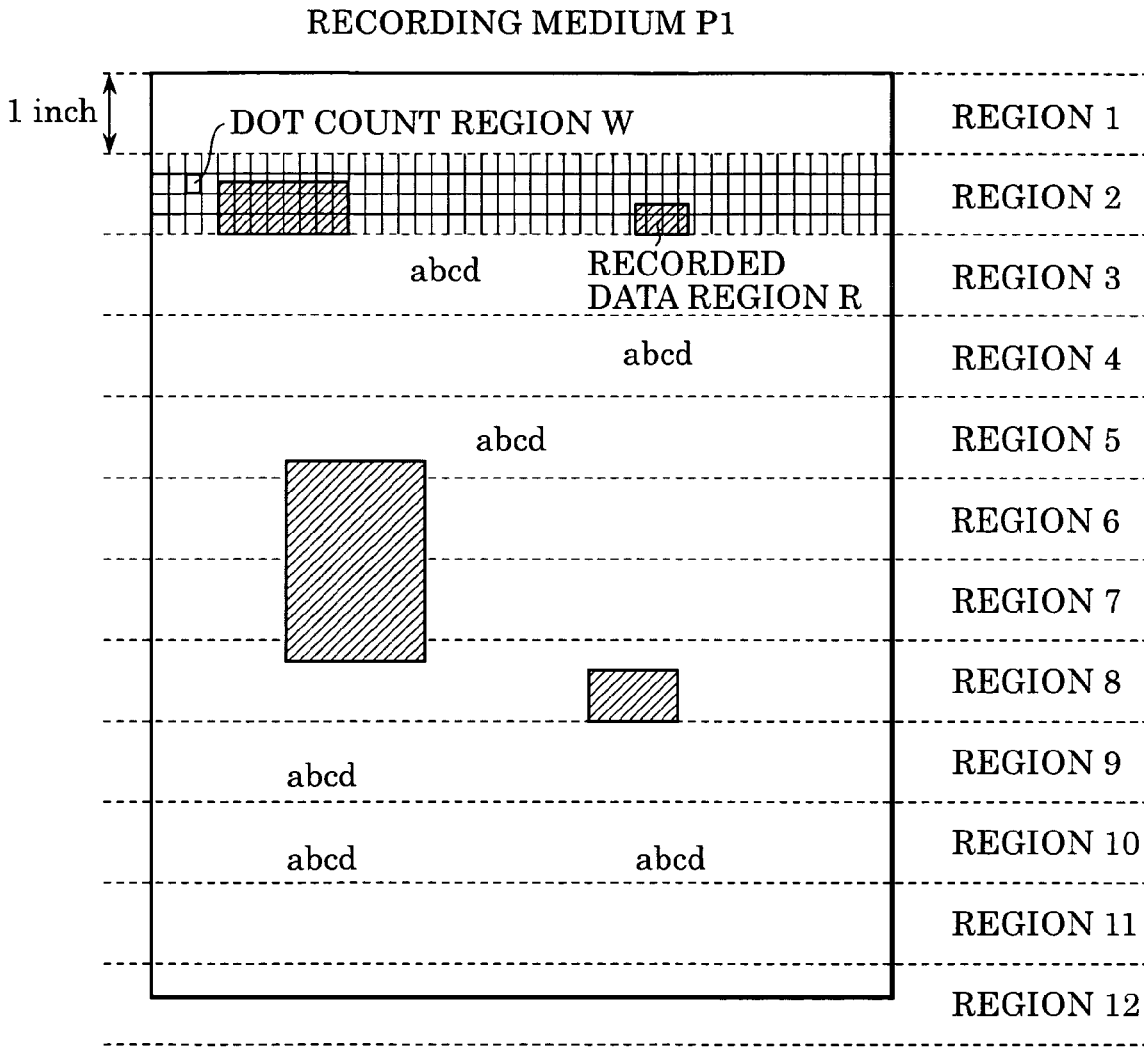
FIG. 8 illustrates that unit regions obtained by dividing the regions on the recording medium in the main scanning direction and in the sub-scanning direction are set as dot count regions.

In the present invention, the divided regions obtained by dividing the region corresponding to one of the surfaces of the recording medium, as shown in FIG. 8, in the main scanning direction (right-left direction in FIG. 8) as well as in the sub-scanning direction (up-down direction in FIG. 8) into a plurality of portions are defined as unit regions to be covered by dot counting (dot count region W). However, the present invention is not limited to this embodiment. For example, the divided region obtained by dividing the region corresponding to one of the surfaces of the recording medium only in the main scanning direction (right-left direction in FIG. 8) may be defined as the above-mentioned unit region (dot count region W), or the divided region obtained by dividing the region corresponding to one of the surfaces of the recording medium only in the sub-scanning direction (up-down direction in FIG. 8) may be defined as the above-mentioned unit region (dot count region W). As described later, however, from the point of view of inhibiting smears, the size of the unit region (dot count region W) should preferably be the smallest possible. It is therefore desirable to divide the region both in the main scanning direction and in the sub-scanning direction.

First Embodiment

The features of a first embodiment of the present invention will now be described.

In the first embodiment, as shown in FIG. 8, for each of a plurality of unit regions (dot count regions W in this case) obtained by dividing the region corresponding to one of the surfaces of the recording medium, information about the quantity of ink to be applied to this unit region (number of recorded dots in this case) is acquired, and on the basis of the thus acquired information, the time from the end of operation relating to recording on one of the surfaces of the recording medium until the start of operation relating to recording on the other surface (operation downtime T, drying time) is determined.

That is, in the present invention, the drying time is not determined in response to the number of recorded dots for the entire area of one of the surfaces of the recording medium as in the above-mentioned U.S. Pat. No. 6,149,327 specification, but the drying time is determined according to the number of recorded dots for each unit region as described above. Therefore, even when small regions having a large number of recorded dots (a high recording duty) locally exist, a relatively long drying time is set, thereby permitting reliable inhibition of the occurrence of smears.

The end of operation relating to recording on one of the surfaces of the recording medium means a point in time when, for example, the last run of scanning is completed and the recording operation is discontinued, or in summary, when the recording medium reaches the standby position and the recording operation is in the stopped state. The start of operation relating to recording on the other surface means a point in time when the above-mentioned recording operation stopping state is cancelled, and the operation is resumed (for example, the conveyance operation necessary for recording on the other surface, or the conveyance operation for reversing the recording medium). As the standby position of the recording medium in the recording operation stopping state, a position near the position where the recording medium is introduced into the reversing unit 90 is appropriate. For example, (1) the position where the last scanning run has been completed; or (2) the position where, after the completion of the last scanning run, the recording medium has been conveyed in the positive direction by a predetermined amount; or (3) the position where, after the completion of the last scanning run, the recording medium has been conveyed in the negative direction by a predetermined amount is suitable.

In this embodiment, the time until the ink drying (ink fixing) in the individual unit regions on the surface subjected to recording has almost been completed is set as the above-mentioned operation downtime (drying time). After the completion of the operation relating to recording on one of the surfaces until the lapse of the operation downtime T, the conveyance operation of the recording medium necessary for recording on the other surface is not started. After the lapse of the operation downtime T and upon substantial completion of the ink drying, the conveyance operation of the recording medium is started. As a result, even by conducting the reversing and conveyance operation for the recording on the other surface, the ink has already been dried on the surface (side already recorded) coming into contact with the conveyance path, thus preventing occurrence of smears.

The smear inhibiting control in this first embodiment will now be described further in detail with reference to FIG. 9.

Figure 9:
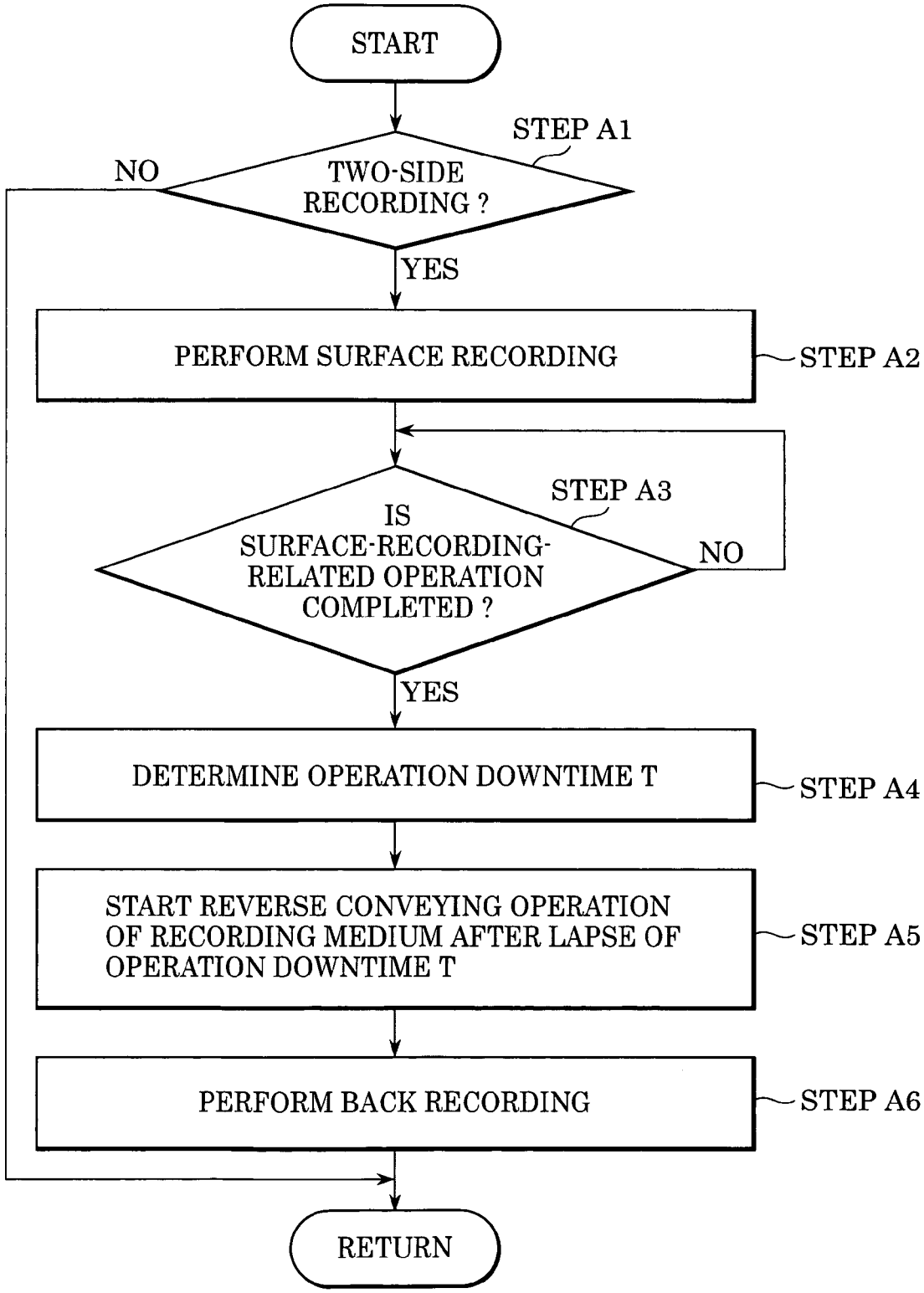
FIG. 9 is a flowchart illustrating a typical sequence of the double-sided recording operation in a first embodiment of the present invention.

In FIG. 9, it is determined, in step A1, which of the recording modes is specified from among the single-sided recording mode in which recording is performed only on one of the surfaces of the recording medium, and the double-sided recording mode in which the two surfaces including one of the surfaces of the recording medium and the other side. Specification of a recording mode may be accomplished by means of a mode specifying switch provided in the recording apparatus, or by means of a printer driver on the host computer connected to the recording apparatus.

If the double-sided recording mode is not specified in step A1, the ordinary single-sided recording is performed, and this sequence is completed. If the two-side recording mode is specified, on the other hand, the process advances to step A2, in which recording is conducted on one of the surfaces of the recording medium. Thereafter, the process goes to step A3, in which it is determined whether or not the operation relating to recording on the surface has been completed. The end of the operation relating to the recording on the surface means a point in time when the last scanning run comes to an end and the recording operation is discontinued, i.e., the moment when the recording medium reaches the standby position.

Then in step A4, the time from the end of operation relating to recording on the surface until the start of operation relating to recording on the back (operation downtime T) is determined. The time required for perfectly fixing the ink in the individual unit regions of the surface subjected first to recording is set as the operation downtime T.

This operation downtime T is determined on the basis of the information relation to the quantity of applied ink for each unit region determined as described above. Particularly in this embodiment, a threshold value for determining whether or not to set an operation downtime T is set in advance. When there is a unit region in which the quantity of applied ink (number of recorded dots in this case) exceeds this threshold value, an operation downtime T is set. In other words, if there exists even a single unit region showing a quantity of imparted ink (number of recorded dots) exceeding a predetermined quantity (a predetermined number in this case) among the plurality of unit regions composing the surface of the recording medium, a prescribed operation downtime is set. If no unit region shows a quantity of applied ink exceeding the above-mentioned predetermined quantity, the operation downtime T is not set. That is, 0 is set for the operation downtime T. More specifically, the present invention is based on a process comprising the steps of counting the number of dots to be recorded in each of unit regions (dot count regions) resulting from division of the region corresponding to the surface of the recording medium as shown in FIG. 8; comparing the count value with the above-mentioned threshold value; and, when the count value exceeds the threshold value, setting a predetermined operation downtime T, or when the count value does not exceed the threshold value, setting an operation downtime T of 0.

When the operation downtime T is thus set, the lapse of this operation downtime T is waited for in step A5. Before the lapse of the operation downtime T, an operation relating to recording on the back, i.e., conveying operation along the above-mentioned second conveyance path for reversing the recording medium P by means of the reversing unit 90 is not carried out. Even when data to be recorded is received, the conveyance operation for recording on the back is not started. Then, after the lapse of the operation downtime T, the operation relating to recording on the back, i.e., the conveyance operation along the second conveyance path for reversing the recording medium P by means of the reversing unit 90 is started.

Subsequently, the recording medium P is reversed in the reversing unit 90. When the recording medium P is conveyed to a position opposite to the recording head, recording on the back is conducted by discharging the ink from the recording head onto the other surface (back) of the recording medium on which recording has not as yet been conducted, in step A6. A sequence in this embodiment is now completed.

Variation 1

A certain operation downtime T is set in the above-mentioned embodiment. More strictly, however, there should be a time required for ink drying (or fixing) in proportion to the extent of the quantity of applied ink per unit area. In order to minimize the necessary ink drying time, therefore, it is desirable to set the length of the operation downtime T variable in response to the extent of the quantity of applied ink. That is, it is desirable to set a much longer operation downtime if the quantity of applied ink is larger, and a much shorter operation downtime T if the quantity of applied ink is smaller.

From among the plurality of unit regions forming the surface of the recording medium, the unit region having the largest number of recorded dots is considered to require the longest time period for ink drying (fixing). The operation downtime T should therefore preferably be determined on the basis of the number of recorded dots in the unit region corresponding to the largest number of recorded dots, from among the plurality of unit regions. In this variation 1, therefore, the number of recorded dots is counted for each of the plurality of unit regions (dot count regions), and the largest number X of recorded dots is required therefrom. On the basis of the largest number X of recorded dots, the operation downtime T is determined with reference to a table (smear table shown in FIG. 19) in which the number X of recorded dots and the operation downtime T are correlated in advance. More specifically, as shown in FIG. 19, when the number X of recorded dots is $0 \leqq X < 1$, an operation downtime T (sec) of TA is set, and when the number X of recorded dots is $N1 \leqq X < N2$, an operation downtime (sec) of TB is set. When the number X of recorded dots is $N2 \leqq X$, an operation downtime T (sec) of TC is set. N1 and N2 satisfy a relationship $0 < N1 < N2$, and TA, TB and TC satisfy a relationship $TA < TB < TC$. Therefore, a larger number of recorded dots in the unit region having the largest number of recorded dots leads to setting of a longer operation downtime T.

In this embodiment, the operation downtimes T are classified into three stages (TA, TB and TC) in accordance with the largest number X of recorded dots. The three stages represent preferable examples, and setting of two stages or four or more stages is also acceptable.

Variation 2

A certain operation downtime T has been provided between the operation relating to recording on the surface and the operation relating to recording on the back in the example shown above. It is also possible to control whether or not an operation downtime T is to be provided according to the kind of ink. The kinds of ink applicable in an ink-jet recording apparatus include penetrating kinds of ink (for example, dye ink) having a high fixability, and superposing kinds of ink (for example, pigment ink) having a low fixability. While dye ink has a high penetrating property into a recording medium P, pigment ink has a low penetrating property, leading to a low fixability. As a result, from the point of view of inhibiting the decrease in throughput caused by providing an operation downtime as described above, it is not always necessary to provide an operation downtime, or it is possible to reduce the operation downtime, depending upon the ink used.

For example, when carrying out recording by the use of only ink having a high fixability (such as dye ink), the operation downtime after the completion of recording on the surface may be shorter than the predetermined operation downtime T, or it is possible to eliminate the operation downtime T. When conducting recording by the use of ink having a low fixability (such as pigment ink), in contrast, it is possible to ensure fixing of the ink on the recording medium P by providing, after the completion of the operation relating to recording on the surface, an operation downtime T as described above, or an operation downtime longer than this. In this way, an unnecessary downtime can be reduced by considering the fixability of the ink, thus permitting improvement of throughput, and production of smears can be reliably prevented, leading to an improved reliability and to a higher general-use property.

Variation 3

Since ink fixability varies with properties of the recording medium P, a useless consumption of the fixing time can be avoided, and the throughput can be improved by changing the operation downtime according to the kind of the recording medium. For example, the fixability of the recording medium P is higher in the order of recording medium C<recording medium B<recording medium A. It is conceivable that a time of 3 seconds when using the recording medium A, a time of 5 seconds when using the recording medium B, or a time of 8 seconds when using the recording medium C is added to correct the above-mentioned operation downtime T to achieve an operation downtime necessary for fixing the ink, and after the lapse of the corrected operation downtime, the operations for recording on the back (conveyance and reversing/conveyance operations) are carried out.

Variation 4

As the ink fixability of a recording medium varies also with the font size of characters recorded on the recording medium, the operation downtime may be corrected according thereto. For example, in the case of (font size)≦25, the time to be added to the operation downtime is 0 seconds; in the case of 25<(font size)≦50, a time of three seconds should be added to the operation downtime; and in the case of 50<(font size), a time of five seconds may be added to the operation downtime.

Variation 5

In the operation stopping state after the completion of the operation relating to recording on the surface, it is possible to cause the user to determine whether the operation stoppage is caused by a malfunction of the apparatus, or is a downtime for fixing, by informing the user of the fact of stoppage, thereby permitting improvement of reliability and maintainability.

According to the first embodiment, as described above, the drying time is not determined according to the quantity of applied ink for the entire area of one of the surfaces of the recording medium, but the drying time is determined on the basis of information about the quantity of ink to be applied to each of the unit regions obtained by dividing the region corresponding to one of the surfaces of the recording medium. As a result, even when small regions of a large quantity of ink (a high recording duty) are locally present, an optimum drying time can be set, thereby permitting reliable inhibition of the occurrence of smears.

Second Embodiment

A second embodiment of the present invention will now be described.

The features of the second embodiment will be described. The second embodiment is characterized in that the time required for ink drying (drying time, operation downtime) is determined by taking into account not only information relating to the quantity of imparted ink for each unit region, but also information relating to the position of the unit region (positional information, recording time information).

More specifically, from among the plurality of unit regions on the surface of the recording medium, unit regions closer to the leading end of the recording medium are subjected to recording in an earlier stage. Drying of the ink is at an advanced state upon the completion of the operation relating to recording on the surface. For the unit regions closer to the trailing end of the recording medium, on the other hand, recording is conducted in a later stage, and drying of the ink goes slow even upon the completion of the operation relating to recording on the surface. The extent of drying of the ink varies with the position of the unit region on the recording medium. It is therefore desirable to determine the ink drying time taking into account also the position of the unit region.

Figure 7:
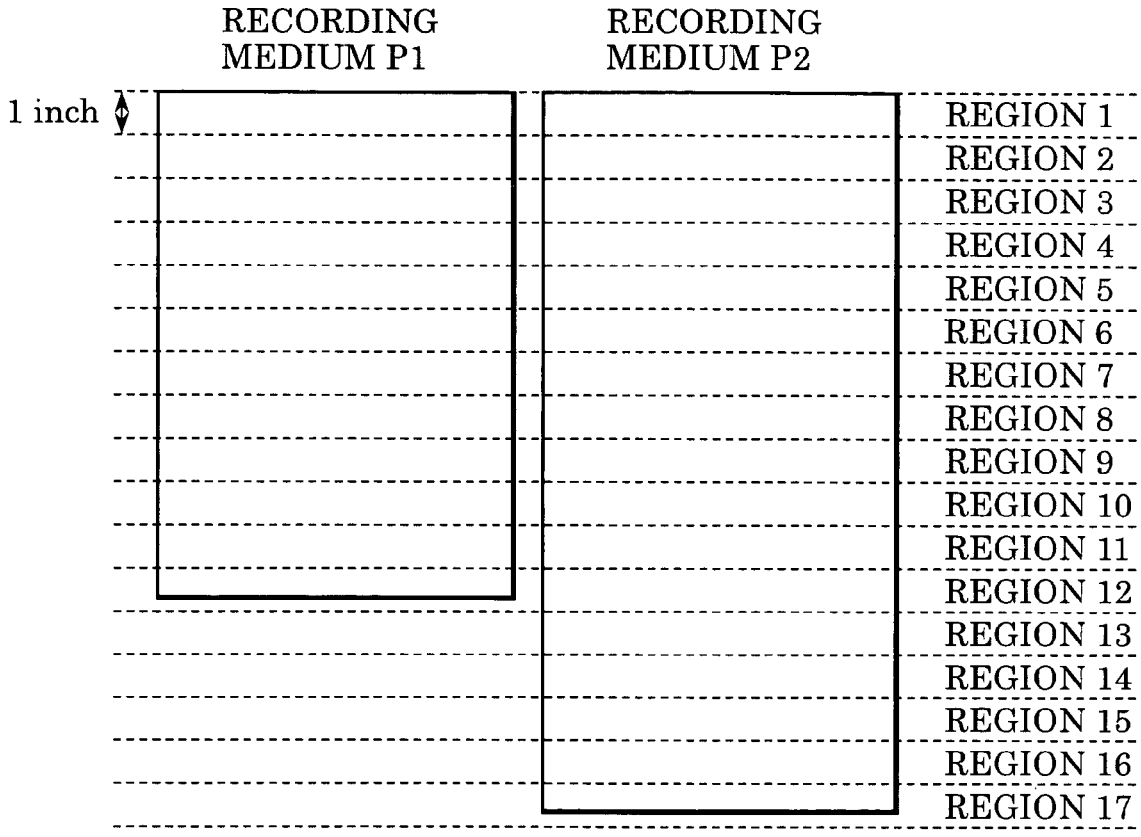
FIG. 7 is a descriptive view illustrating a plurality of control regions obtained by dividing the regions on the recording medium in the sub-scanning direction in a second embodiment of the present invention.

In this embodiment, therefore, as shown in FIGS. 7 and 8, the region corresponding to the surface of the recording region corresponding to the surface of the recording medium is divided in the sub-scanning direction into a plurality of control regions (regions 1 to 12), and for each of these plurality of control regions, information about the largest number of recorded dots in the unit region and positional information of that unit region are acquired. The operation downtime is determined on the basis of the thus acquired largest number of recorded dots and positional information of that unit region.

Figure 10:
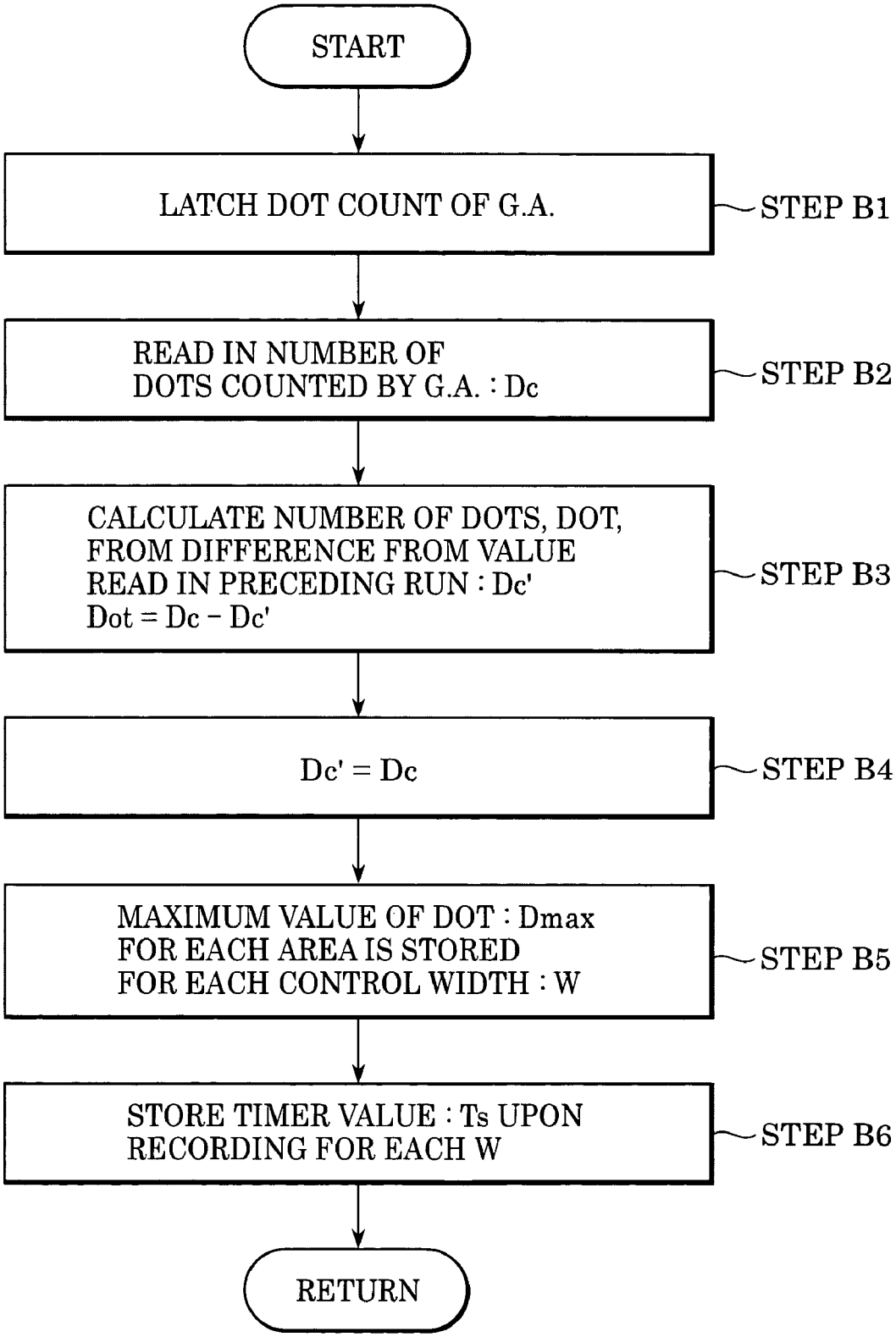
FIG. 10 is a flowchart illustrating a typical sequence of the smear inhibiting control in a second embodiment of the present invention.

The smear inhibiting control executed in this second embodiment will now be described further in detail with reference to FIGS. 7, 8 and 10. In this second embodiment, region Nos. are assigned as shown in FIG. 7, and the length in the sub-scanning direction of various recording media P is detected in compliance therewith. That is, the regions on the recording medium P are divided every inch in the sub-scanning direction into control regions L each having a width of 1 inch. Simultaneously with the start of the paper feed operation, counting of each control region is started. The length in the sub-scanning direction if the recording medium P is detected by means of the count value. For example, the fact that the recording medium P1 shown in FIG. 7 has a length of 12 inches and has 12 regions is known from integration of the amounts of paper feed from paper feed up to passage by the PE sensor (paper end sensor). In this embodiment for which a maximum length of the recording medium is assumed to be up to 17 inches, 17 regions on the memory are retained. The recording medium P2 can be determined to have a maximum length of 17 inches. The amount of retained memory can be derived from the maximum length of the recording medium in the sub-scanning direction applicable to the recording apparatus.

FIG. 8 illustrates a case where there is recorded an image in which recorded regions showing a high recording duty as in recording of a black solid portion and recorded regions of a low recording duty as in recording of a text are mixed. Among others, the double-sided recording operation when recording such a mixed image on the both sides of the recording medium will be described. From among the pages, the regions of a high recording duty, i.e., the regions in which black solid portions are recorded are covered by smear inhibiting control, and the regions in which only the text is recorded are not covered by smear inhibiting control. More specifically, from among the plurality of control regions (regions 1 to 12), the regions 2, 6, 7 and 8 are covered by smear inhibiting control. In a black solid recorded portion recorded over a plurality of regions in the center portion, the manner of reflection of a dot count value may differ with the positional relationship with the recorded data regions R, the dot count regions W, and the control region width (the width corresponding to the conveyance pitch of the recording medium conveyed intermittently in the sub-scanning direction). For example, even a single continuous image is covered by smear control in the regions 6 and 7, whereas, in the region 5, the image is not covered by smear inhibiting control because of a small maximum number of recorded dots of the dot count region in the control regions thereof.

Whether or not a region is covered by smear inhibiting control is decided, depending upon whether or not the number of unit regions showing a number of recorded dots exceeding the predetermined number exist. That is, when there are unit regions showing a number of recorded dots exceeding a predetermined number (threshold value), the control region including these unit regions is covered by smear inhibiting control. When there is no unit region showing a number of recorded dots exceeding the predetermined number, on the other hand, this control region is not covered by smear inhibiting control. When a region is covered by smear inhibiting control, an operation downtime is provided. When a region is not covered by smear inhibiting control, no operation downtime is provided.

Concrete processes are as follows. Dot counting is performed for each of a plurality of unit regions (dot count regions W) for each control region, and the maximum dot count value is acquired therefrom. It is determined whether or not the maximum dot count value exceeds a predetermined threshold value by comparing the maximum dot count value with the predetermined threshold value. In other words, it is determined, for each of the above-mentioned control regions (regions 1 to 12), whether or not unit regions of a high recording duty to be covered by the smear inhibiting control are contained in the page (surface) to be first subjected to recording. For a control region containing a unit region of a high recording duty exceeding the prescribed threshold value, the maximum dot count value and the positions of the unit regions are stored. For example, in the example shown in FIG. 8, the maximum dot count value and the position of the unit region are stored for the regions 2, 6, 7 and 8. In this example, the position of the control region in the sub-scanning direction is set forth as the position of the unit region.

Then, the time required until the unit region showing the maximum dot count value stored as described above no further produces smears is determined on the basis of the position of the unit region and the dot count value thereof for each of these control regions. More specifically, a table correlating the position of the unit region and the dot count value with the time up to the elimination of the risk of occurrence of smears is provided in advance, and the time required until the region becomes free from the risk of an occurrence of smears is determined on the basis of the position of the unit region and the dot count value. Since ink fixing is at a higher degree for unit regions closer to the leading end of the recording medium, the above-mentioned table is prepared by taking into account this fact. For each of the control regions (regions 2, 6, 7 and 8) containing the unit regions of a high recording duty to be covered by smear inhibiting control, the time required until the region becomes free from the risk of an occurrence of smears is determined. Among the times determined for the individual control regions, the maximum time is adopted as the above-mentioned operation downtime.

In other words, the region conjectured to show the worst ink fixing state at the moment when the operation relating to recording on the surface is completed is determined on the basis of the position of the unit region and the dot count value thereof, and the time required for completely fixing the region of the worst fixing state is set forth as the above-mentioned operation downtime. After the lapse of the operation downtime thus determined, the recording medium P is conveyed to the reversing/conveyance path 93. After reversing the recording medium P through the reversing/conveyance path 93, the recording medium is conveyed to a position where the recording medium becomes opposite to the recording head, and reversing is carried out by discharging the ink from the recording head to the back of the recording medium. This permits inhibition of occurrence of smears, thereby enabling to achieve a satisfactory result of recording, and to prevent the occurrence of secondary smears.

In the above-mentioned case, the time required for elimination of the risk of smear occurrence of the unit region showing the maximum dot count value has been determined only for the control regions containing the unit regions to be covered by smear inhibiting control. This embodiment is not however limited to this. As shown in FIG. 10, for each of a plurality of control regions forming the surface of the recording medium, the times required until elimination of the risk of smear occurrence on the unit region showing the maximum dot count value may be determined, and the longest time among these times may be adopted as the above-mentioned operation downtime.

In the example shown above, the positional information of unit regions has been stored. Information not of the position itself may be used so far as it is information corresponding to the position of a unit region. For example, as illustrated in FIG. 10, information of the time Ts recording the unit region may be stored.

A typical sequence of smear inhibiting control applicable in this embodiment will now be described with reference to the flowchart shown in FIG. 10. In step B1, recording data entered via the interface 105 is entered into the gate array (G.A.) as dot data which is then latched. The number of dots of an image to be recorded is counted by counting the number of dots of the thus latched dot data (binary value). Then in step B2, the number of dots Dc counted by the gate array 104 is read in. In step B3, the number of dots Dot recorded within a certain period of time is calculated by determining a difference between a dot count value Dc' read in the preceding run and a latest number of dots Dc.

In this embodiment, under conditions including a latching interval of about 10 msec and a driving frequency of the recording head of 10 kHz, dot counting is carried out for 100 dots in the main scanning direction for every latching interval. Since 160 nozzles are arranged in the nozzle train direction on the recording head, the dot count region W subjected to dot counting for every latching interval has a size of 160×100 dots. The number of dots within this dot count region W is counted.

Then in step B4, the read new dot count value Dc is written over the dot count value Dc' read in the preceding run. In step B5, maximum value Dmax among the numbers of dots Dot counted within the individual dot count regions W is stored for each counted region width L. The term the control region width L as herein used means a width corresponding to the amount of conveyance of the recording medium conducted intermittently in the sub-scanning direction, or a width in the sub-scanning direction (1 inch in FIGS. 7 and 8) of the regions assigned numbers such as regions 1, 2, . . . , N (N is a positive integer) in FIGS. 7 and 8.

Finally in step B6, the times when recording is performed are stored for each control region width L. In this embodiment, the time Ts is measured by the use of a timer built in the MPU 101.

As described above, the maximum dot count value Dmax in the dot count region W and the time Ts of the unit region recording are stored for each control region width L. As the maximum dot count values Dmax, only values exceeding a threshold value predetermined as described above may be stored, or the values may be stored irrespective of whether or not the predetermined threshold value is exceeded.

For each control region, the time required until the unit region showing the maximum dot count value becomes free from the risk of occurrence of smears is determined on the basis of the maximum dot count value Dmax and the time Ts of recording in the unit region. The longest time from among the times determined in correspondence to the individual control regions is set as the operation downtime.

Variations

Figure 17:
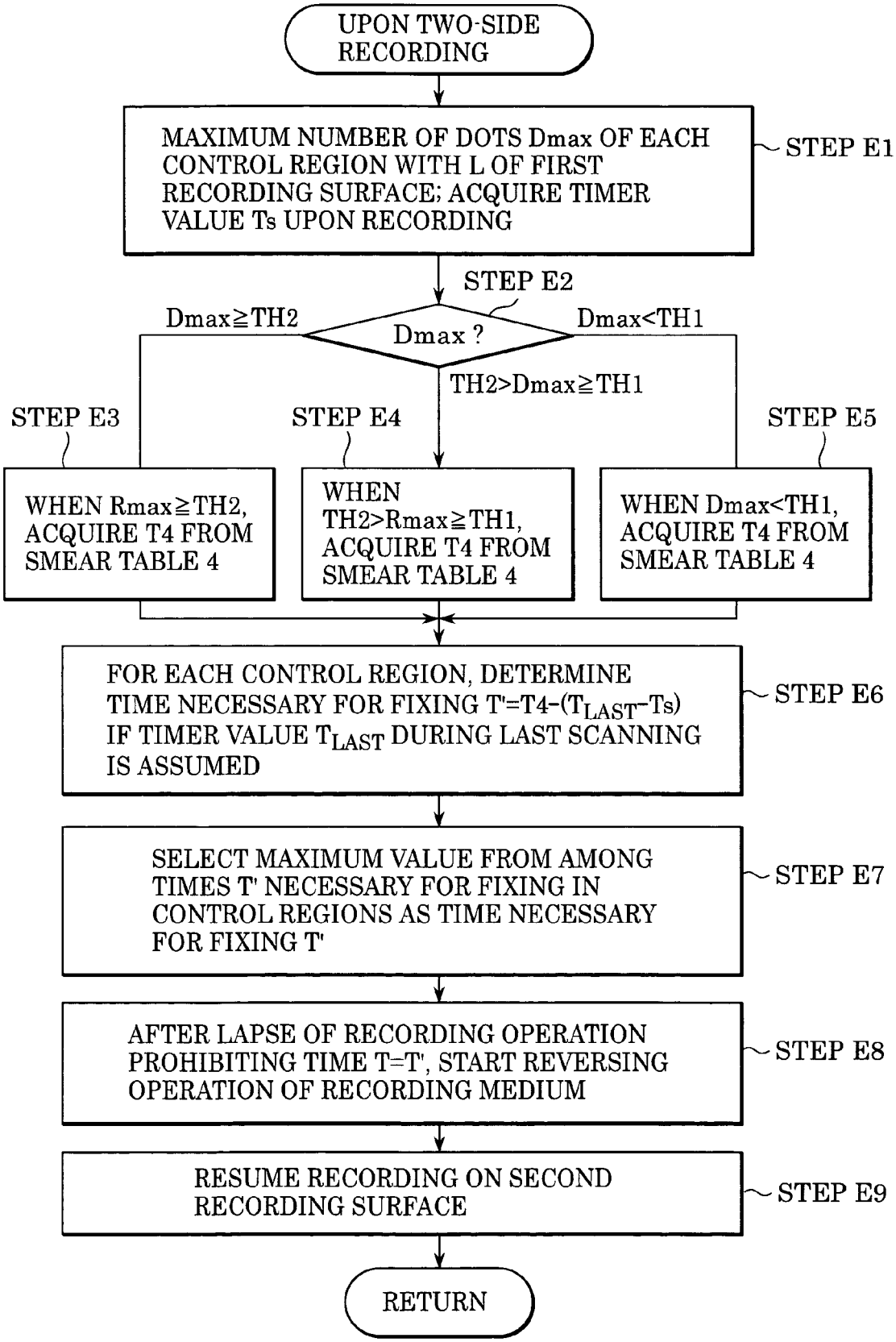
FIG. 17 is a flowchart illustrating the sequence of the double-sided recording operation in a variation of the second embodiment of the invention.

Variations of the second embodiment will now be described with reference to the flowchart shown in FIG. 17. In FIG. 17, first in step E1, a maximum number of dots Dmax and a timer value Ts upon recording the unit region are acquired for each of a plurality of control regions forming the first recording surface of the recording medium.

Then in step E2, the maximum number of dots Dmax acquired in step E1 is compared with a plurality of threshold values (three threshold values TH1, TH2 and TH3 in this example) to determine the relative magnitude. If Dmax is larger than the threshold value TH2, the process advances to step C3, and if Dmax is larger than the threshold value TH1 and smaller than the threshold value TH2, the process goes to step E4. If Dmax is smaller than the threshold value TH1, then, the process advances to step E5. In steps E3, E4 and E5, a time T4 considered necessary for fixing is acquired in accordance with the smear table 4 shown in FIG. 18.

The smear table 4 shown here determines an operation downtime T4 by considering not only the number of dots Dmax, but also the fixability of the ink used. That is, in this smear table 4, recording modes 1, 2 and 3 are provided in the order of lower fixability of the ink used. As ink of a lower fixability is used in a recording mode, the operation downtime T4 is longer, and as the dot count value is larger, the operation downtime T4 is longer.

As shown in the recording mode 3, when the ink used has a high fixability, and the dot count value is small, the operation downtime is set at 0 so that a standby operation is not exceeded during the period of transfer from recording on the surface to recording on the back. Furthermore, for example, pigment ink falls under the category of ink having a low fixability, and for example, dye ink falls under the category of ink having a high fixability. Therefore, the above-mentioned mode 1 may be considered to be a mode in which only pigment ink is applicable; mode 2, pigment ink and dye ink are applicable; and mode 3, only dry ink is applicable.

Then in step E6, times required from the individual control regions up to the last control regions (Tlast−Ts) are calculated, respectively, from the timer values Ts upon recording in the individual control regions and the timer value Tlast upon recording in the last control region. The time T' required for fixing, taking into account the time difference caused by the position of recording by subtracting the value resulting from the above calculation from the time T4 considered necessary for fixing.

Then in step E7, the time T' determined in step E6 is set as the operation downtime. In step E8, after the lapse of this operation downtime T=T', stoppage of recording is cancelled, and the reversing operation of the recording medium is started. Finally in step E9, recording on the back is conducted.

According to the second embodiment, as described above, the time required for ink drying (drying time, operation downtime) is determined by taking into account not only the information about the quantity of applied ink for each unit region, but also the information about the position of the unit region (positional information, recording time information, etc.). It is therefore possible to set a drying time considering even a difference in the degree of ink drying according to the position on the recording medium. As a result, the occurrence of smears in the conveyance path including the reversing path can be inhibited while maintaining the throughput on a high level by setting a short drying time.

Third Embodiment

A third embodiment of the present invention will now be described. In the third embodiment, the operation downtime is determined while considering not only the information about the quantity of imparted ink for each unit region, but also the information about fixability of the ink used.

Figure 11:
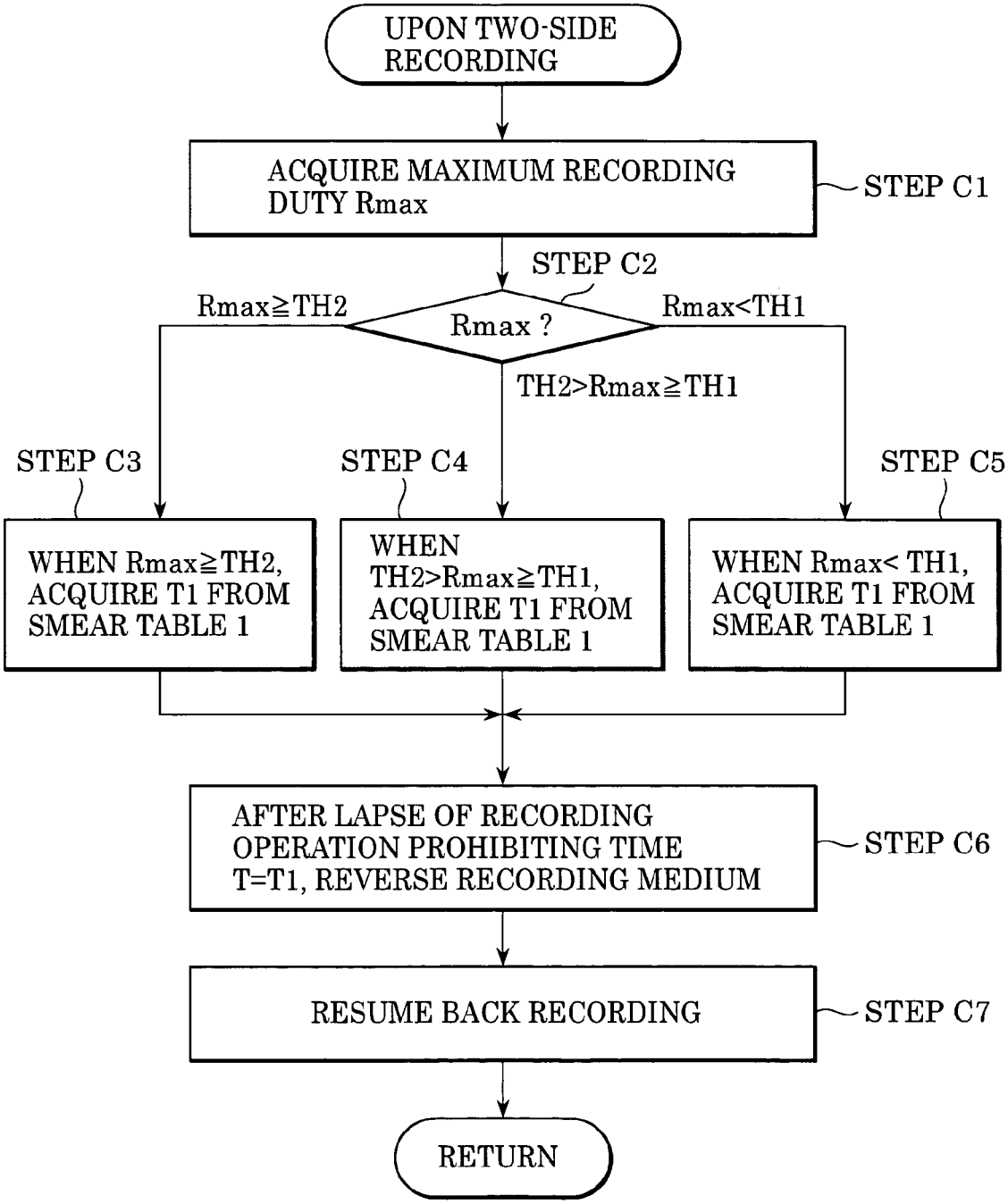
FIG. 11 is a flowchart illustrating a typical sequence of the double-sided recording operation in a third embodiment of the present invention.

The sequence including the smear inhibiting control during double-sided recording operation will be described with reference to the flowchart shown in FIG. 11. First in step C1, a maximum value is selected from among a plurality of maximum numbers of dots Dmax for individual control region width L on the surface of the recording medium through the control operation shown in FIG. 10. A maximum recording duty Rmax is determined on the basis of the thus selected maximum value and stored.

Then in step C2, the maximum recording duty Rmax acquired in step C1 is compared to a plurality of threshold values (three threshold values TH1, TH2 and TH3 in this case) to determine the relative magnitude. If Rmax is larger than the threshold value TH2, the process advances to step C3, and if Rmax is larger than TH1 and smaller than the threshold value TH2, the process advances to step C4. If Rmax is smaller than the threshold value TH1, the process goes to step C5. In steps C3, C4 and C5, the time T1 considered necessary for fixing is acquired in accordance with the smear table 1 shown in FIG. 13.

Then in step C6, the time T1 acquired in step C5 is set as the operation downtime. After the lapse of this operation downtime T=T1, stoppage of recording operation is cancelled, and the reversing operation indispensable for recording on the back is carried out. Finally, the process goes to step C7 to conduct recording on the back.

A smear table based on conditions including a threshold value TH1 of 30% and a threshold value TH2 of 50% is shown in FIG. 13. The smear table 1 determines the operation downtime T1 by taking into account not only the recording duty Rmax, but also the fixability of the ink used. That is, in this smear table 1, recording modes 1, 2 and 3 are provided in order of lower fixability of the ink used so that the operation downtime T1 is longer in a recording mode using ink of a lower fixability, and the operation downtime T1 is longer when the recording duty is higher. As shown in the recording mode 3, when the ink used has a high fixability and the recording duty is low, the operation downtime is set at 0 so that no standby operation is conducted during transfer from recording on the surface to recording on the back.

For example, pigment ink falls under the category of ink having a low fixability, and for example, dye ink falls under the category of ink having a high fixability. Therefore, the above-mentioned mode 1 may be considered to be a mode in which only pigment ink is applicable; mode 2, pigment ink and dye ink are applicable; and mode 3, only dye ink is applicable.

In this third embodiment, as described above, the operation downtime T can be modified or set on the basis of the maximum recording duty on one of the surfaces of the recording medium and the fixability of the ink used for recording on this surface. It is therefore possible to inhibit the occurrence of smears in the conveyance path including the reversing path, and to efficiently perform recording operation, thus permitting maintenance of throughput on a high level.

Fourth Embodiment

A fourth embodiment of the present invention will now be described.

In the fourth embodiment, as in the above-mentioned second embodiment variation, it is possible to more reliably and more efficiently inhibit the occurrence of smears by determining the operation downtime T' during which the start of operation relating to recording on the back is discontinued on the basis of the maximum number of recorded dots on the surface, and connecting the above-mentioned recording operation downtime T' by taking into account the environmental temperature and the recording head temperature upon recording operation of the surface.

Because the quantity of discharged ink generally increases or decreases with a change in the environmental temperature or the head temperature, the time required for ink fixing on the recording medium changes accordingly. When a larger quantity of discharge leads to a longer fixing time, the conveying operation and the reversing/conveying operation for recording on the back is started before perfect fixing of the ink, resulting in the risk of the occurrence of smears or secondary smears. In this embodiment, therefore, when there is an increase in the environmental or recording head temperature, a longer fixing time is provided to avoid an occurrence of smears caused by temperature. On the other hand, when the environmental temperature and the recording head temperature are low, and the quantity of discharge from the recording head decreases, the fixing time is reduced to ensure efficient recording without impairing performance of the ink-jet recording apparatus. In this embodiment also, the apparatus has a configuration shown in FIGS. 1 to 4, further comprising a head temperature sensor which detects the recording head temperature and an environmental temperature sensor which detects temperature around the apparatus.

Figure 12:
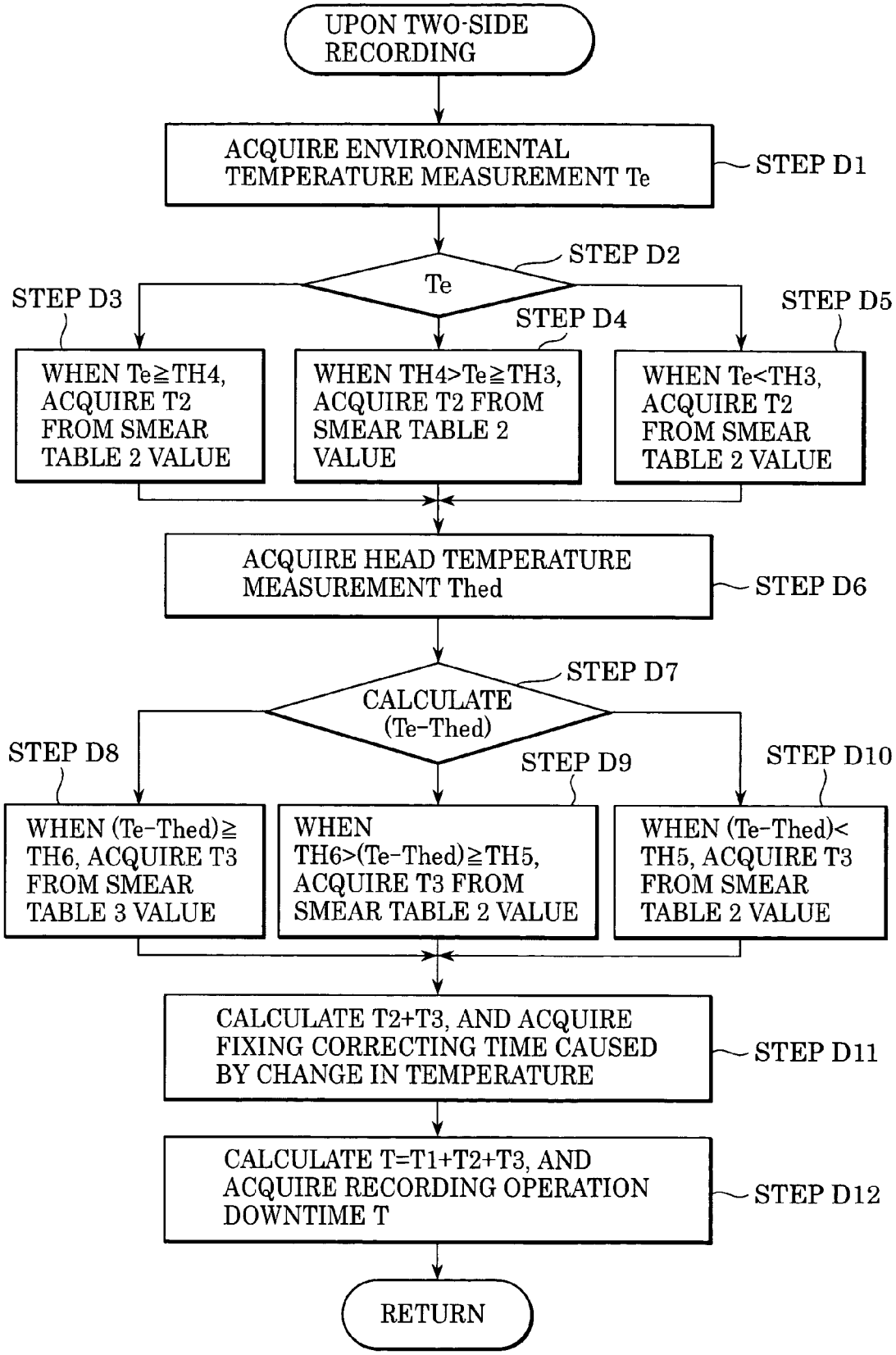
FIG. 12 is a flowchart illustrating a typical sequence of the double-sided recording operation in a fourth embodiment of the present invention.

The determining operation of the recording operation downtime to alleviate the effect of a change in the environmental temperature or the head temperature in the fourth embodiment will be described on the basis of the flowchart shown in FIG. 12.

In step D1, after the completion of recording on the surface of the recording medium, the environmental temperature Te is acquired by means of an environmental temperature sensor provided on the base of the recording apparatus. Then in step D2, relative sizes of the value of the environmental temperature Te and predetermined threshold values TH3 and TH4 are determined. If the environmental temperature Te is larger than the threshold value TH2, the process advances to step D4. If the environmental temperature Te is smaller than the threshold value TH3 and larger than the threshold value TH4, the process goes to step D4. If the environmental temperature Te is smaller than the threshold value TH4, the process advances to step D5. In each of steps D3, D4 and D5, a correction time T2 during stoppage of operation is acquired in accordance with the smear table 2 shown in FIG. 14.

Then in step D6, the head temperature Thed is acquired by means of the head temperature detecting sensor. Then in step D7, the difference in temperature between the head temperature Thed and the environmental temperature Te (Thed−Te) is determined. If this temperature difference (Thed−Te) is over the threshold value TH6, the process goes to step D8. If the temperature difference (Thed−Te) is smaller than the threshold value TH6 and larger than the threshold value TH5, the process advances to step D9. If the temperature difference (Thed−Te) is smaller than the threshold value TH5, the process goes to step D10. In each of steps D8, D9 and D10, a correction fixing time T3 corresponding to the recording head and the environmental temperature is acquired in accordance with the smear table 3 shown in FIG. 15.

Then in step D11, the value of addition (T2+T3) of the recording operation downtimes T2 and T3 acquired in steps D6 and D1 is determined, and the result is set as the correction time in response to the change in temperature. Thereafter, in step D12, the correction time T2+T3 and the fixing time T' determined in the same manner as in the variation in the above-mentioned second embodiment are added together, thus acquiring an operation downtime T (=T'+T2+T3).

The smear table 2 shown in FIG. 14 represents a case based on conditions including a threshold value TH3 of 15° C. and a threshold value TH4 of 25° C. The smear table 3 shown in FIG. 15 represents a case based on conditions including a threshold value TH5 of 10° C. and a threshold value TH6 of 20° C. The recording modes 1, 2 and 3 shown in FIGS. 14 and 15 represent values of fixability of ink: the recording modes 1, 2 and 3 are set in the order of lower ink fixability values, and a lower ink fixability corresponds to a longer correction time. In each of the modes, a higher temperature Te or a larger temperature difference (Thed−Te) leads to setting of a longer correction time. In this embodiment, therefore, dispersion of the ink fixing time caused by a change in the environmental temperature or the head temperature can be taken into account, permitting achievement of a more reliable and more efficient recording operation, and it is possible to inhibit the occurrence of smears and secondary smears.

Fifth Embodiment

In the above-mentioned embodiments, an operation downtime during the period from recording on the surface up to transfer to recording on the back is set by considering the number of recorded dots, the recording duty, the environmental temperature, and the recording head temperature. As in this fifth embodiment, it is also possible to carry out a more efficient recording operation by changing the applied ink between recording on the surface and recording on the back.

More specifically, when performing double-sided recording by the use of only black pigment ink (Bk ink) low in ink fixability, smear control requires a longer recording operation downtime. In the fifth embodiment, therefore, the fixing time to the recording medium is reduced by mixing black ink using high-fixability dye ink (PCBk ink) such as C, M or Y with black pigment ink. This makes it possible to reduce the recording operation downtime and to perform more efficient recording operation.

In this case, in order to reduce the operation downtime as far as possible, the percentage of the dye-based PCBk ink is increased in the surface recording operation than in the recording operation on the back, and the percentage of the pigment-based Bk ink is decreased. However, since the change in the ratio of the dye-based ink to the pigment-based ink may result in a difference in density, setting of the percentage must be conducted while considering this possibility. For the recording operation on the back, in contrast, the percentage of the dye-based PCBk ink is reduced, and the percentage of the pigment-based Bk ink is increased.

When setting the ratio of the dye-based ink to the pigment-based ink, it is necessary to take into account the phenomenon known as a back penetration in which the ink used for the surface penetrates too much into the recording medium to reach even the back. Dye-based ink has a high fixability, but an excessive amount of ink may cause a back penetration as a result of an excessive penetration into the recording medium. This phenomenon, if produced, results in inconveniences such as stains on the back or deterioration of quality of an image recorded on the back. It is therefore important to set percentage of the dye-based ink and the pigment-based ink within a range not causing back penetration or a change in the density. A decrease in the image quality is also caused upon occurrence of back penetration under the effect of recording on the back.

In this fifth embodiment, therefore, percentages as shown in FIG. 16 are set as a typical example of the mixing ratio of the dye-based ink to the pigment-based ink which permits reduction of the operation downtime.

For the Bk ink, a case of injection of 30 pl at a recording density of 600 dpi was assumed to have a percentage of 100%, and for the PCBk ink, a case of injection of 10 pl for each color at a recording density of 600 dpi was assumed to have a percentage of 100%. The surface recording was carried out with a Bk of 37.2% and a PCBk of 24.7%, and the back recording was conducted with a Bk of 43.5% and a PCBk of 12.2%.

The PCBk ink and the Bk ink were mixed at the ratio as described above, and recording was applied on the surface and the back. As a result, the ink fixing time on the surface was reduced, making it possible to reduce the recording operation downtime. On the other hand, a difference in ink concentration between the surface and the back and occurrence of a back penetration were eliminated, thus permitting conducting a more reliable and more efficient double-sided recording.

For an ink-jet printer permitting simultaneous use of the dye-based black ink (PhotoBK ink) applied for recording photo-like images, and the pigment-based Bk ink, it is possible to conduct recording by, for example, the following combination:

(1) When single-sided recording, only the pigment-based Bk ink is used, and when double-sided recording, only the dye-based PhotoBK ink;

(2) When single-sided recording, only the pigment-based Bk ink is used, and when double-sided recording, the dye-based PhotoBK ink and the PCBk ink are used in combination;

(3) When single-side recording, only the pigment-based Bk ink is used, and when double-sided recording, the pigment-based Bk ink, the pigment-based PhotoBK ink and the PCBk ink are used in combination.

By using kinds of ink in combination as described above, it is possible to reduce the recording operation downtime, and transfer from surface recording to back recording rapidly. As a result, it is possible to perform recording more efficiently while inhibiting the decrease in throughput upon double-sided recording, and reliably inhibit occurrence of smears and secondary smears.

Other Embodiments

The above-mentioned embodiments have been described on the assumption that the reversing unit 90 had a form attachable to the recording apparatus. It may however be integrated with the recording apparatus. In this case, an automatic double-sided recording section 9 is built in the recording apparatus.

The above-mentioned embodiments have been described on the assumption that the apparatus had a form acquiring information about the quantity of applied ink of the unit regions, with reference to typical forms in which the number of binary data corresponding to the unit regions are counted. The present invention is not however limited to this. In place of counting binary data, the apparatus may take the form of determining the density level of multi-value data prior to binarization, so far as the data correspond to the quantity of applied ink.

The present invention may be applied to a system comprising a plurality of devices (for example, a host computer, an interface device, a reader, a printer, etc.) or to an apparatus comprising a single device (for example, a copying machine, a facsimile machine).

The present invention is also applicable to a case where an apparatus or a computer in a system are connected to various devices to operate them so as to achieve functions of the above-mentioned embodiments; software program codes for achieving such functions of the embodiments are supplied to such an apparatus or computer to operate these various devices in accordance with the programs thus supplied and mounted to and on the system or the computer (CPU or MPU).

In this case, the software program codes themselves serve to achieve the functions of the embodiments, and the program codes themselves, and means for supplying such program codes to the computer, such as a storage medium storing these program codes are within the scope of the present invention.

Storage media storing such program codes include a Floppy disk, a hard disk, an optical disk, a magneto-optical disk, a CD-ROM, a magnetic tape, a non-volatile memory card, and a ROM.

The functions of the above-mentioned embodiments are achieved by the computer to which the program codes are supplied through computer's execution. Cases where the functions of the embodiments are achieved by these program codes in combination with an OS (operating system) operating in the computer or other application software programs are also within the scope of the present invention. For example, program codes corresponding to at least a part of the flowcharts shown in FIGS. 9 and 17 are within the scope of the present invention.

The present invention is not limited by the number of recording heads or the kind thereof, but is applicable to ink-jet recording apparatuses mounting various numbers of heads and any of various kinds of recording head. That is, the applicable recording modes include not only the recording mode using only a main color of black, but also recording modes such as a multi-color of different colors or full color mode based on mixture of colors. The present invention is applicable to ink-jet recording apparatuses capable of executing these recording modes.

It should particularly be noted that various modifications can be applied to the above-mentioned embodiments without departing from the teaching of the present invention. Particularly, all the matters contained in the present disclosure, or all the matters shown in the attached drawings, should be interpreted to be for showing examples, and should not be interpreted to be for limitation. The scope of the present invention should be decided on the basis of the patent claims.

Aspects

Aspects of the present invention will now be presented.

Aspect 1

An ink-jet recording apparatus which permits recording on one surface of a recording medium and on the other surface by causing relative scanning of a recording head discharging ink onto the recording medium, comprising:

acquiring means of acquiring information about the quantity of ink to be applied to a unit region of a plurality of unit regions obtained by dividing a region corresponding to the one surface of the recording medium into a plurality of portions; and determining means which determines the length of time from the end of operation relating to recording on one of the surfaces of the recording medium, until the start of operation relating to recording on the other surface of the recording medium.

Aspect 2

An ink-jet recording apparatus according to aspect 1, wherein the end of operation relating to recording on one of the surfaces of the recording medium is a point in time when the last scanning run of the recording head of one of the surfaces is completed and the recording operation comes to an end; and the start of operations relating to recording on the other surface of the recording medium is a point in time when conveying operation necessary for recording on the other surface is started.

Aspect 3

An ink-jet recording apparatus according to aspect 1, wherein the end of operation relating to recording on one of the surfaces of the recording medium is a point in time when the last run of scanning of the recording head on one of the surfaces is completed and the recording operation comes to an end; and the start of operation relating to recording on the other surface of the recording medium is a point in time when a conveying operation for causing reversal of the recording medium on the one surface of which recording has been conducted is started.

Aspect 4

An ink-jet recording apparatus which permits recording on one and the other surfaces of a recording medium by causing a recording head for discharging ink to perform relative scanning of the recording medium, comprising:

judging means which judges a specified recording mode from among a single-sided recording mode comprising the steps of performing recording on one of the surfaces of the recording medium, and then, discharging the recording medium on one of the surfaces of which recording has been conducted, and a double-sided recording mode comprising the steps of performing recording on one of the surfaces of the recording medium, then, reversing the recording medium after the recording in the apparatus, and performing recording on the other surface of the recording medium;

acquiring means which acquires information about the quantity of ink to be applied to each of a plurality of unit regions obtained by dividing the area corresponding to one surface of the recording medium, when the double-sided recording mode is specified; and determining means which determines the length of time from the end of operation relating to recording on one of the surfaces of the recording medium, until the start of operation relating to recording on the other surface of the recording medium;

wherein the determining means determines the length of time on the basis of information about the quantity of applied ink for each unit region acquired by the acquiring means.

Aspect 5

An ink-jet recording apparatus according to any one of aspects 1 to 4, wherein the acquiring means acquires the information about the quantity of applied ink by counting the number of binary data corresponding to the unit regions.

Aspect 6

An ink-jet recording apparatus according to any one of aspects 1 to 4, wherein the acquiring means acquires the information about the quantity of applied ink on the basis of the density level of multi-value data corresponding to the unit regions.

Aspect 7

An ink-jet recording apparatus according to any one of aspects 1 to 6, wherein the determining means selects a longer period of time than the time when the applied quantity shown by the information about the quantity of applied ink acquired by the acquiring means is larger.

Aspect 8

An ink-jet recording apparatus according to any one of aspects 1 to 6, wherein the determining means determines the length of time on the basis of the position of a unit region showing the maximum quantity of applied ink from among the plurality of unit regions.

Aspect 9

An ink-jet recording apparatus according to any one of aspects 1 to 6, further comprising:

storage means which stores information about the position of the unit region showing the maximum quantity of applied ink and information about the maximum quantity of applied ink, for each of a plurality of control regions obtained by dividing the region corresponding to one surface of the recording medium in the sub-scanning direction into the plurality of control regions;

wherein the determining means determines the length of time on the basis of the information stored in the storage means.

Aspect 10

An ink-jet recording apparatus according to any one of aspects 1 to 6, wherein the determining means determines the length of time on the basis of the information showing the maximum quantity of applied ink from among the pieces of information relating to the quantity of applied ink corresponding to the individual unit regions.

Aspect 11

An ink-jet recording apparatus in which, after performing recording on one of the surfaces of a recording medium conveyed along a first conveyance path by discharging ink from a recording head, the recording medium is conveyed along a second conveyance path at least partially different from the first conveyance path, and then, recording is performed by means of the recording head on the other surface of the recording medium, comprising:

acquiring means which acquires information about the quantity of ink to be applied to each of a plurality of unit regions obtained by dividing the region corresponding to one of the surfaces of the recording medium into a plurality of portions;

determining means which determines an operation downtime on the basis of the information about the quantity of applied ink acquired as above; and operation stopping means which performs control so that the recording medium after recording on the one surface does not start conveyance operation along the second conveyance path for a period after the end of the operation relating to recording on the one surface of the recording medium until the lapse of the determined operation downtime.

Aspect 12

An ink-jet recording apparatus according to aspect 11, wherein the second conveyance path includes the reversing path through which the recording medium after the recording on one surface is reversed.

Aspect 13

An ink-jet recording apparatus according to aspect 11, wherein the operation downtime is changed on the basis of at least the kind of information from among the information about the kind of ink, the information about the kind of recording medium, the information about the font size, the information about the environmental temperature around the recording head, and the information about the temperature of the recording head, and the information about the quantity of applied ink.

Aspect 14

An ink-jet recording apparatus according to aspect 11, further comprising:

display means which displays that an operation stopping state is currently caused by the operation stopping means.

Aspect 15

An ink-jet recording apparatus, comprising:

first conveying means which conveys the recording medium along a first conveyance path, and a second conveying means which conveys the recording medium along a second conveyance path at least partially different from the first conveyance path; which after performing recording by at least one of a plurality of heads capable of discharging kinds of ink different in fixability onto the back of the recording medium conveyed along the first conveying means, conveys the recording medium along the second conveyance path by the second conveying means, and performs recording by at least one of the plurality of recording heads onto the back of the recording medium;

wherein the recording apparatus further comprises discharge control means which controls the discharge ratio of ink discharged from the recording heads;

the discharge control means causes discharge of a plurality of kinds of ink differing in fixability onto at least the surface from among the surface and the back of the recording medium.

Aspect 16

An ink-jet recording apparatus according to aspect 15, wherein a plurality of kinds of ink differing in fixability are discharged onto the surface and the back of the recording medium; and the discharge ratio of the individual kinds of ink differing in fixability discharged onto the surface are made different from the discharge ratios of the individual kinds of ink differing in fixability discharged onto the back.

Aspect 17

An ink-jet recording apparatus according to aspect 15 or 16, wherein the discharge control means which changes the discharge ratios of pigment-based Bk ink and dye-based PCBk ink discharged onto the recording medium are made different between upon recording on the surface of the recording medium and recording on the back thereof.

Aspect 18

An ink-jet recording apparatus according to any one of aspects 15 to 17, wherein the discharge control means which control the discharge ratio of the pigment-based Bk ink discharged upon recording on the surface of the recording medium to a higher level than the discharge ratio of the pigment-based Bk ink discharged upon recording on the back, and controls the discharge ratio of the dye-based PCBk ink to a lower level than the discharge ratio of the dye-based PCBk ink discharged upon recording on the back.

Aspect 19

An ink-jet recording apparatus, comprising first conveying means which conveys a recording medium along a first conveyance path, and a second conveying means which conveys the recording medium along a second conveyance path at least partially different from the first conveyance path; wherein after performing recording by means of an ink-jet recording head capable of discharging a plurality of kinds of ink differing in fixability onto the back of the recording medium conveyed along the first conveyance path, the recording medium is conveyed along the second conveyance path by the second conveying means, and recording is performed onto the back of the recording medium by means of the ink-jet recording head;

wherein the ink-jet recording apparatus further comprises discharge control means which selects ink to be discharged from the individual ink-jet recording head;

wherein, upon recording on the surface of the recording medium, the discharge control means causes discharge of ink having a higher fixability than the ink discharged upon recording on the back.

Aspect 20

An ink-jet recording apparatus, comprising first conveying means which conveys a recording medium along a first conveyance path, and a second conveying means which conveys the recording medium along a second conveyance path at least partially different from the first conveyance path; wherein, after performing recording by means of an ink-jet recording head capable of discharging a plurality of kinds of ink differing in fixability onto the back of the recording medium is conveyed along the first conveyance path, the recording medium is conveyed along the second conveyance path by the second conveying means, and recording is performed onto the back of the recording medium by means of the ink-jet recording head;

wherein the ink-jet recording apparatus further comprise discharge control means which selects ink to be discharged from the individual ink-jet recording heads;

the discharge control means selects ink to be discharged in single-sided recording and double-sided recording from pigment-based Bk, dye-based PhotoBk, and dye-based PCBk.

Aspect 21

A method for controlling an ink-jet recording apparatus which causes a recording head for discharging ink to relatively scan a recording medium, thereby permitting recording on one surface and the other of the recording medium, comprising:

an acquiring step for acquiring information about the quantity of ink to be imparted to individual unit regions obtained by dividing the region corresponding to the one surface of the recording medium, for each such unit region; and a determining step, when determining the length of time from the end of operation relating to recording on one of the surfaces of the recording medium until the start of operation relating to recording on the other surface of the recording medium, for determining the length of the time on the basis of information about the quantity of applied ink for each of the unit regions acquired in the acquiring step.

What is claimed is:

1. An ink-jet recording apparatus capable of recording on one surface of a recording medium and the other surface thereof by causing a recording head for discharging ink to relatively scan the recording medium in a first direction, comprising:

acquiring means which acquires information about the quantity of ink to be applied to individual unit regions obtained by dividing a region corresponding to the one surface of said recording medium in the first direction and in a second direction perpendicular to the first direction; and determining means which determines the length of time from the end of operation relating to recording on one of the surfaces of said recording medium, until the start of operation relating to recording on the other surface of said recording medium;

wherein said determining means determines said length of time on the basis of information showing the maximum quantity of applied ink from among pieces of information relating to the quantity of applied ink for the individual unit regions acquired by said acquiring means.

2. An ink-jet recording apparatus according to claim 1, wherein the end of operations relating to recording on one of the surfaces of said recording medium is a point in time when the last scan of said recording head on said one of the surfaces is completed.

3. An ink-jet recording apparatus according to claim 1, wherein the end of operations relating to recording on one of the surfaces of said recording medium is a point in time when the recording medium on which recording has been conducted reaches a standby position.

4. An ink-jet recording apparatus according to claim 3, wherein the standby position is a position where, after the completion of the last scan on said one of the surfaces, the recording medium has been conveyed by a predeterminded amount.

5. An ink-jet recording apparatus according claim 1, wherein said acquiring means acquires the information about said quantity of applied ink by counting the number of binary data corresponding to said unit region.

6. An ink-jet recording apparatus according to claim 1, wherein said acquiring means acquires the information about said quantity of applied ink on the basis of the density level of multi-value data corresponding to said unit region.

7. An ink-jet recording apparatus according to claim 1, wherein said determining means determines said length of time on the basis of the information showing the maximum quantity of applied ink and the information about a position in the second direction of the individual unit region showing the maximum quantity of applied ink.

8. An ink-jet recording apparatus according to claim 1, wherein said acquiring means acquires the information showing the maximum quantity of applied ink, for respective control regions, the control region including the unit regions indicative of same positions in the second direction; and wherein said determining means determines said length of time on the basis of the information showing the maximum quantity of applied ink for the respective control regions.

9. An ink-jet recording apparatus according to claim 1, wherein the start of operations relating to recording on the other surface of said recording medium is a point in time when a conveying operation necessary for recording on the other surface is started.

10. An ink-jet recording apparatus capable of recording on one and the other surfaces of a recording medium by causing a recording head for discharging ink to perform relative scanning of said recording medium, in a first direction, comprising:

judging means which judges a specified recording mode from among a single-sided recording mode comprising the steps of performing recording on one of the surfaces of the recording medium, and then, discharging said recording medium on one of the surfaces of which recording has been conducted, and a double-sided recording mode comprising the steps of performing recording on one of the surfaces of said recording medium, then, reversing said recording medium after said recording in the apparatus, and performing recording on the other surface of said recording medium;

acquiring means which acquires information about the quantity of ink to be applied to individual unit regions obtained by dividing an area corresponding to one surface of said recording medium in the first direction and in a second direction perpendicular to the first direction, when said double-sided recording mode is specified; and determining means which determines the length of time from the end of operation relating to recording on one of the surfaces of said recording medium, until the start of operation relating to recording on the other surface of said recording medium;

wherein said determining means determines said length of time on the basis of information showing the maximum quantity of applied ink from among the pieces of information relating to the quantity of applied ink for the individual unit regions acquired by said acquiring means.

11. An ink-jet recording apparatus in which, after performing recording on one of the surfaces of a recording medium conveyed along a first conveyance path by discharging ink from a recording head, the recording medium is conveyed along a second conveyance path at least partially different from said first conveyance path, and then, recording is performed by means of said recording head on the other surface of said recording medium, comprising:

acquiring means which acquires information about the quantity of ink to be applied to individual unit regions obtained by dividing a region corresponding to one of the surfaces of said recording medium in a first direction and in a second direction perpendicular to the first direction;

determining means which determines an operation downtime on the basis of the information showing the maximum quantity of applied ink from among pieces of information relating to the quantity of applied ink, for the individual unit regions, acquired by said acquiring means; and operation stopping means which performs control so that the recording medium after recording on said one surface does not start a conveyance operation along said second conveyance path for a period after the end of the operation relating to recording on said one surface of the recording medium until the lapse of said determined operation downtime.

12. An ink-jet recording apparatus according to claim 11, wherein said second conveyance path includes the reversal path through which the recording medium is reversed after the recording on said one surface.

13. An ink-jet recording apparatus according to claim 11, wherein said operation downtime is determined on the basis of at least the kind of information from among the information about the kind of ink, the information about the kind of recording medium, the information about the font size, the information about the environmental temperature around said recording head, and the information about the temperature of said recording head, and the information showing the maximum quantity of applied ink.

14. An ink-jet recording apparatus according to claim 11, further comprising:

display means which displays that an operation stopping state is currently caused by said operation stopping means.

15. A method for controlling an ink-jet recording apparatus which causes a recording head for discharging ink to relatively scan a recording medium in a first direction, thereby permitting recording on one surface and the other of said recording medium, comprising:

an acquiring step for acquiring information about the quantity of ink to be applied to individual unit regions obtained by dividing a region corresponding to said one surface of the recording medium in the first direction and in a second direction perpendicular to the first direction, for said individual unit regions; and a determining step for determining the length of time from the end of operation relating to recording on one of the surfaces of said recording medium until the start of operation relating to recording on the other surface of said recording medium;

wherein, in said determining step, said length of time is determined on the basis of the information showing the maximum quantity of applied ink from among the pieces of information relating to the quantity of applied ink for the individual unit regions acquired in said acquiring step.

* * * * *